US007236149B2

(12) United States Patent
Yamashita et al.

(10) Patent No.: US 7,236,149 B2
(45) Date of Patent: Jun. 26, 2007

(54) PIXEL CIRCUIT, DISPLAY DEVICE, AND DRIVING METHOD OF PIXEL CIRCUIT

(75) Inventors: Junichi Yamashita, Tokyo (JP); Katsuhide Uchino, Kanagawa (JP); Tetsuro Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 588 days.

(21) Appl. No.: 10/847,414

(22) Filed: May 18, 2004

(65) Prior Publication Data

US 2005/0007357 A1 Jan. 13, 2005

(30) Foreign Application Priority Data

May 19, 2003 (JP) ..... 2003-140871

(51) Int. Cl.
*G09G 3/30* (2006.01)

(52) U.S. Cl. ..... 345/76; 345/80

(58) Field of Classification Search ..... 345/76–83, 345/204, 205; 315/169.1, 169.2, 169.3, 169.4
See application file for complete search history.

(56) References Cited

U.S. PATENT DOCUMENTS 7,023,408 B2 * 4/2006 Chen et al. ..... 345/82
2003/0184509 A1 * 10/2003 Chen et al. ..... 345/90
2005/0002260 A1 * 1/2005 Koyama ..... 365/222
2005/0116907 A1 * 6/2005 Miyazawa ..... 345/76
2006/0061293 A1 * 3/2006 Kobayashi et al. ..... 315/169.3
2007/0007527 A1 * 1/2007 Koyama ..... 257/59

OTHER PUBLICATIONS

U.S. Appl. No. 10/847,414, filed May 18, 2004, Yamashita et al.
U.S. Appl. No. 10/557,800, filed Nov. 18, 2005, Uchino et al.

* cited by examiner

*Primary Examiner*—Nitin I. Patel
(74) *Attorney, Agent, or Firm*—Oblon, Spivak, McClelland, Maier & Neustadt, P.C.

(57) ABSTRACT

A pixel circuit able to stably and correctly supply a current having a desired value to a light emitting diode of each pixel without being influenced by variation of a threshold value of an active element inside the pixel or variation of mobility and able to display a high quality image as a result of this, wherein a TFT as a fourth switch is turned on together with a TFT as a second switch at the time of an auto-zero operation, a reference current line is connected to a drive transistor of the pixel through a first node, and the variation of the threshold value Vth is corrected, whereby variation of the on current due to the mobility at the time of a white display can be suppressed and the uniformity with respect to variation in the mobility can be greatly enhanced, and a display device and a driving method of the pixel circuit.

19 Claims, 24 Drawing Sheets

1f
1H
LIGHT EMISSION
Vcc−Vth
2/3 Vsig
2/3 Vsig
AUTO ZERO PERIOD
(VTH CORRECTION PERIOD)
FIG. 4A ws[1]: TFT24
FIG. 4B ws[2]
FIG. 4C az[1]: TFT23
FIG. 4D az[2]
FIG. 4E ds[1]: TFT22
FIG. 4F ds[2]
FIG. 4G Vg
(TFT21)

1f
1H
1H
LIGHT EMISSION
LIGHT EMISSION
LIGHT EMISSION
LIGHT EMISSION
Vo
2/3 Vsig
2/3 Vsig
ZERO PERIOD
(VTH, MOBILITY CORRECTION PERIOD)
FIG. 10A ws[1]:TFT114
FIG. 10B ws[2]
FIG. 10C az[1]:TFT113,115
FIG. 10D az[2]
FIG. 10E ds[1]:TFT112
FIG. 10F ds[2]
FIG. 10G Vg
(TFT101)

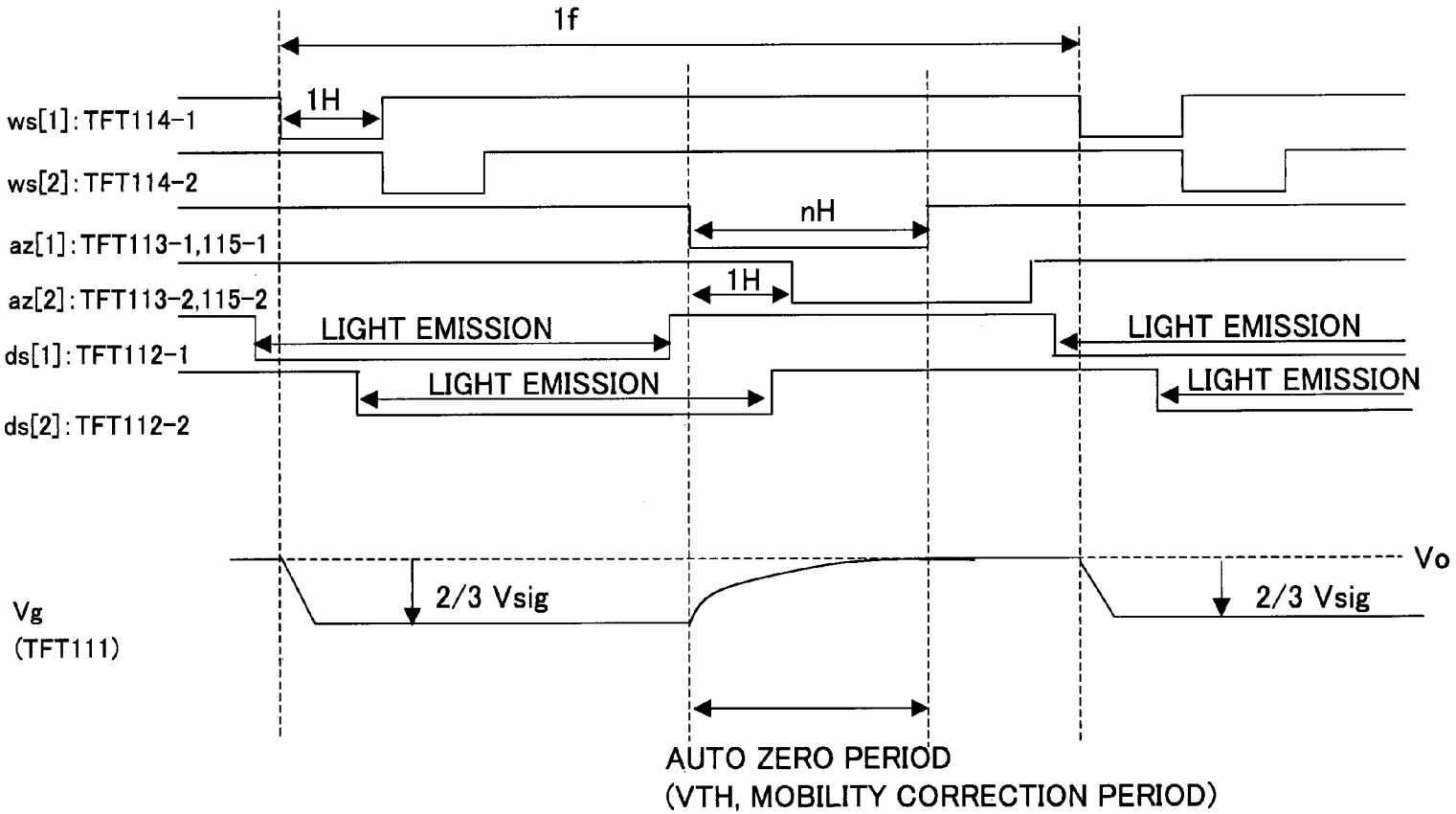
1f
1H
nH
1H
LIGHT EMISSION
LIGHT EMISSION
LIGHT EMISSION
LIGHT EMISSION
Vo
2/3 Vsig
2/3 Vsig
AUTO ZERO PERIOD
(VTH, MOBILITY CORRECTION PERIOD)
FIG. 19A ws[1]: TFT114-1
FIG. 19B ws[2]: TFT114-2
FIG. 19C az[1]: TFT113-1,115-1
FIG. 19D az[2]: TFT113-2,115-2
FIG. 19E ds[1]: TFT112-1
FIG. 19F ds[2]: TFT112-2
FIG. 19G Vg (TFT111)

1f
1H
1H
LIGHT EMISSION
LIGHT EMISSION
LIGHT EMISSION
LIGHT EMISSION
Vo
Vref
2/3 Vsig
2/3 Vsig
Vref
PRECHARGE
AUTO ZERO PERIOD
(VTH, MOBILITY CORRECTION PERIOD)
FIG. 23A VREF PULSE
FIG. 23B ws[1]:TFT114
FIG. 23C ws[2]
FIG. 23D az[1]:TFT113,115
FIG. 23E az[2]
FIG. 23F ds[1]:TFT112
FIG. 23G ds[2]
FIG. 23H Vg (TFT111)

PIXEL CIRCUIT, DISPLAY DEVICE, AND DRIVING METHOD OF PIXEL CIRCUIT

BACKGROUND OF THE INVENTION

1. Field of the Invention

The present invention relates to a pixel circuit having an organic electroluminescence (EL) element or other electro-optic element with a luminance controlled by a current value and an image display device comprised of such pixel circuits arrayed in a matrix, in particular a so-called active matrix type image display device controlled in value of current flowing through the electro-optic elements by insulating gate type field effect transistors provided inside the pixel circuits, and a driving method of the pixel circuits.

2. Description of the Related Art

In an image display device, for example, a liquid crystal display, a large number of pixels are arranged in a matrix and the light intensity is controlled for every pixel in accordance with the image information to be displayed so as to display an image. This same is true for an organic EL display etc. An organic EL display is a so-called self light emitting type display having a light emitting element in each pixel circuit and has the advantages that the viewability the image is higher in comparison with a liquid crystal display, a back-light is unnecessary, the response speed is high, etc. Further, it greatly differs from a liquid crystal display etc. in the point that the gradations of the color generation are obtained by controlling the luminance of each light emitting element by the value of the current flowing through to, that is, the light emitting element is a current controlled type.

An organic EL display, in the same way as a liquid crystal display, may be driven by a simple matrix and an active matrix system, but while the former has a simple structure, it has the problem that realization of a large sized and high definition display is difficult. For this reason, much effort is being devoted to development of the active matrix system of controlling the current flowing through the light emitting element inside each pixel circuit by an active element provided inside the pixel circuit, generally, a thin film transistor (TFT).

FIG. 1 is a block diagram of the configuration of a general organic EL display device. This display device 1 has, as shown in FIG. 1, a pixel array portion 2 comprised of pixel circuits (PXLC) 2*a* arranged in an m×n matrix, a horizontal selector (HSEL) 3, a write scanner (WSCN) 4, data lines DTL1 to DTLn selected by the horizontal selector 3 and supplied with a data signal in accordance with the luminance information, and scanning lines WSL1 to WSLm selectively driven by the write scanner 4.

FIG. 2 is a circuit diagram of an example of the configuration of a pixel circuit 2*a* of FIG. 1 (refer to for example U.S. Pat. No. 5,684,365 and Japanese Unexamined Patent Publication (Kokai) No. 8-234683. The pixel circuit of FIG. 2 has the simplest circuit configuration among the large number of proposed circuits and is a so-called two-transistor driving system circuit.

The pixel circuit 2*a* of FIG. 2 has a p-channel thin film field effect transistor (hereinafter, referred to as TFT) 11 and TFT 12, a capacitor C11, and a light emitting element made of an organic EL element (OLED) 13. Further, in FIG. 2, DTL indicates a data line, and WSL indicates a scanning line. An organic EL element has a rectification property in many cases, so sometimes is referred to as an organic light emitting diode (OLED). The symbol of a diode is used as the light emitting diode in FIG. 2 and the other figures, but a rectification property is not always required for an organic EL element in the following explanation. In FIG. 2, a source of the TFT 11 is connected to a power supply potential VCC, and a cathode of the light emitting diode 13 is connected to a ground potential GND. The operation of the pixel circuit 2*a* of FIG. 2 is as follows.

Step ST1

When the scanning line WSL is made a selected state (low level here) and a write potential Vdata is supplied to the data line DTL, the TFT 12 becomes conductive, the capacitor C11 is charged or discharged, and the gate potential of the TFT 11 becomes Vdata.

Step ST2

When the scanning line WSL is made a non-selected state (high level here), the data line DTL and the TFT 11 are electrically separated, but the gate potential of the TFT 11 is held stably by the capacitor C11.

Step ST3

The current flowing through the TFT 11 and the light emitting diode 13 becomes a value in accordance with a gate-source voltage Vgs of the TFT 11, while the light emitting diode 13 is continuously emitting light with a luminance in accordance with the current value. As in the above step ST1, the operation of selecting the scanning line WSL and transmitting the luminance information given to the data line to the inside of a pixel will be referred to as "writing" below. As explained above, in the pixel circuit 2*a* of FIG. 2, if once the Vdata is written, the light emitting diode 13 continues to emit light with a constant luminance in the period up to the next rewriting.

As explained above, in the pixel circuit 2*a*, by changing a gate application voltage of the drive transistor constituted by the TFT 11, the value of the current flowing through the EL light emitting element 13 is controlled. At this time, the source of the drive transistor of p-channel is connected to the power supply potential VCC, so this TFT 11 is always operating in a saturated region. Accordingly, it becomes a constant current source having a value shown in the following equation 1.

$$Ids = \tfrac{1}{2} \cdot \mu (W/L) \mathrm{Cox} (\mathrm{Vgs} - |\mathrm{Vth}|)^2 \quad (1)$$

Here, μ indicates the mobility of a carrier, Cox indicates a gate capacitance per unit area, W indicates a gate width, L indicates a gate length, Vgs indicates the gate-source voltage of the TFT 11, and Vth indicates the threshold value of the TFT 11.

In a simple matrix type image display device, each light emitting diode emits light only at a selected instant, while in an active matrix, as explained above, the light emitting element continues emitting light even after the end of the writing. Therefore, it becomes advantageous in especially a large sized and high definition display in the point that the peak luminance and peak current of the light emitting element can be lowered in comparison with a simple matrix.

However, TFTs generally exhibit large variation in the Vth and mobility μ. For this reason, even if the same input voltage is supplied to the gates of different drive transistors, the on current thereof will vary. As a result, the uniformity of the image quality will deteriorate.

In order to alleviate this problem, a large number of pixel circuits have been proposed. A typical example is shown in FIG. 3 (refer to for example U.S. Pat. No. 6,229,506 and Japanese National Publication (Tokuhyo) No. 2002-514320).

A pixel circuit 2*b* of FIG. 3 has p-channel TFT 21 to TFT 24, capacitors C21 and C22, and a light emitting element made of an organic EL light emitting diode (OLED) 25.

Further, in FIG. 3, DTL indicates a data line, WSL indicates a scanning line, AZL indicates an auto-zero line, and DSL indicates a drive line.

An explanation will be given below of the operation of this pixel circuit 2*b* while referring to the timing charts shown in FIGS. 4A to 4G. FIG. 4A shows a scanning signal ws[1] applied to the scanning line WSL1 of the first row of the pixel array; FIG. 4B shows a scanning signal ws[2] applied to the scanning line WSL2 of a second row of the pixel array, FIG. 4C shows an auto-zero signal az[1] applied to the auto-zero line AZL1 of the first row of the pixel array; FIG. 4D shows an auto-zero signal az[2] applied to the auto-zero line AZL2 of the second row of the pixel array; FIG. 4E shows a drive signal ds[1] applied to the drive line DSL1 of the first row of the pixel array; FIG. 4F shows a drive signal ds[2] applied to the drive line DSL2 of the second row of the pixel array; and FIG. 4G shows a gate potential Vg of the TFT21. Note that, the operation of the pixel circuit of the first row will be explained below.

As shown in FIGS. 4C and 4E, the drive signal ds[1] to the drive line DSL1 and the auto-zero signal az[1] to the auto-zero line AZL1 are made the low level, and the TFT 22 and TFT 23 are made the conductive state. At this time, the TFT 21 is connected to the light emitting element (OLED) 25 in a diode-connected state, so the current flows through the TFT 21. At this time, the gate potential Vg of the TFT 21 falls as shown in FIG. 4G.

As shown in FIG. 4E, the drive signal ds[1] to the drive line DSL1 is made the high level, and the TFT 22 is made the non-conductive state. At this time, when the scanning signal ws[1] to the scanning line WSL1 is the high level, the TFT 24 is held in the non-conductive state as shown in FIG. 4A. Along with the TFT 22 becoming the non-conductive state, the current flowing through the light emitting element 25 is shut off, therefore, as shown in FIG. 4G, the gate potential Vg of the TFT 21 rises, but the TFT 21 becomes the non-conductive state and the potential becomes stable at the point of time when the potential rises up to Vcc−|Vth|. This operation will be referred to as an "auto-zero operation".

As shown in FIG. 4C, the auto-zero signal az[1] to the auto-zero line AZL1 is made the high level and the TFT 23 is made the non-conductive state to terminate the auto-zero operation (Vth correction operation), then the drive signal ds[1] to the drive line DSL1 is made the low level to make the TFT 22 the conductive state.

Then, the scanning signal ws[1] to the scanning line WSL1 is made the low level as shown in FIG. 4A.*to* make the TFT 24 is made the conductive state and a data signal having a predetermined potential propagated through the data line DTL1 is applied to the capacitor C21. Due to this, as shown in FIG. 4G, the gate potential of the TFT 21 is lowered by exactly ΔVg via the capacitor C21. As shown in FIG. 4A, the scanning line WSL1 is made the high level to make the TFT 24 the non-conductive state. Due to this, the current flows through the TFT 21 and the EL light emitting element (OLED) 25, and the EL light emitting element 25 starts to emit light.

Summarizing the problems to be solved by the invention as explained above, in the pixel circuit of FIG. 3, by turning on the auto-zero switch constituted by the TFT 23 during a period when the EL light emitting diode 25 does not emit light, the drive transistor TFT21 is made a cut-off state. In the cut-off state, no current flows through this transistor TFT 21, so the gate-source voltage Vgs thereof becomes equal to the threshold value Vth of each transistor, and the Vth variation for every pixel is cancelled. Next, by turning off the TFT 23, then turning on the TFT 24, a voltage ΔV is coupled with the gate of the drive transistor TFT21 through the capacitor C21 in the pixel of the data line voltage. Assuming that this coupling amount is V0, the drive transistor TFT 21 will not depend upon the Vth, an on current corresponding to Vgs−Vgh=V0 flows, and an image quality without unevenness of uniformity due to Vth variation is obtained.

In the pixel circuit of FIG. 3, however, even if the Vth variation can be corrected, the variation of the mobility μ cannot be corrected. Below, this problem will be explained in further detail in relation to the drawings.

FIG. 5 is a graph of characteristic curves of ΔV (=Vgs−Vth) of drive transistors having different mobilities and the drain-source current Ids in the pixel circuit of FIG. 3. In FIG. 5, an abscissa represents the voltage ΔV, and an ordinate represents the current Ids. Further, in FIG. 5, a curve indicated by a solid line indicates the characteristic of a pixel A, and a curve indicated by a broken line indicates the characteristic of a pixel B.

As shown in FIG. 5, the mobility is different between the characteristic of the pixel A indicated by the solid line and the characteristic of the pixel B indicated by the broken line. In the pixel circuit system of FIG. 3, at the auto-zero point (ΔV=V0), the current value is equal even between pixel transistors having different mobilities. However, as the voltage rises thereafter, the variation of the mobility μ appears in the current value. For example, in the pixel A and the pixel B having different mobilities, even when the same voltage ΔV=V0 is applied, variation of the current Ids occurs according to the above equation 1 and the luminances of the pixels become different. That is, a large current flows, the current value ends up being affected by the variation of the mobility as it becomes bright, the uniformity varies, and the image quality ends deteriorating.

Further, FIG. 6 is a graph of the change of the gate voltage of the drive transistor at the time of an auto-zero operation at pixels C and D having different threshold values Vth of the drive transistor. In FIG. 6, the abscissa represents the time t, and the ordinate represents the gate voltage Vgs. Further, in FIG. 6, a curve indicated by the solid line indicates the characteristic of a pixel C, and a curve indicated by the broken line indicates the characteristic of a pixel D.

The auto-zero operation is carried out by connecting the gate and the source of the drive transistor. Also, the on current thereof rapidly decreases as it approaches the cut-off region. For this reason, a long time is required until the variation of the cut-off threshold value is completely cancelled. As shown in FIG. 6, when the auto-zero time is insufficient, the variation of the threshold value Vth is not completely cancelled in the pixel C. In this way, due to the variation of the threshold value Vth, it is also believed that variation occurs even in the writing state of the gate voltage and therefore the uniformity is deteriorated due to this.

Further, even if the variation of the threshold value Vth is cancelled by taking sufficient time for the auto-zero operation, an off current will flow through the drive transistor after the cut-off, though small in amount. For this reason, as shown in FIG. 7, the gate voltage gradually rises toward the power supply voltage Vcc. As a result, regardless of the fact that variation of the threshold value Vth was once cancelled by the auto-zero operation, the gate potentials of the pixels having the threshold value Vth variation finally become uniform toward the power supply voltage, so the variation of the threshold value Vth appears again.

From the above description, in order to effectively cancel the variation of the threshold value Vth in an actual device, it is necessary to optimally adjust the auto-zero period for every panel. However, this adjustment of the optimum auto-zero period for every panel takes an enormous amount of time and raises the cost of the panels.

SUMMARY OF THE INVENTION

An object of the present invention is to provide a pixel circuit, a display device, and a driving method of the pixel circuit able to stably and correctly supply a current having a desired value to the light emitting element of each pixel without regard to variation of the threshold values of the active elements inside the pixels of course and the variation of the mobility and as a result able to display a high quality image.

To attain the above object, according to a first aspect of the present invention, there is provided a pixel circuit for driving an electro-optic element with a luminance changing according to a flowing current, comprising a data line through which a data signal in accordance with luminance information is supplied; a first control line; first, second, and third nodes; first and second reference potentials; a reference current supplying means for supplying a predetermined reference current; a drive transistor forming a current supply line between a first terminal and a second terminal connected to the first node and controlling a current flowing through the current supply line in accordance with the potential of the control terminal connected to the second node; a first switch connected to the first node; a second switch connected between the first node and the second node; a third switch connected between the data line and the third node and controlled in conduction by the first control line; a fourth switch connected between the first node and the reference current supplying means; and a coupling capacitor connected between the second node and the third node, wherein the current supply line of the drive transistor, the first node, the first switch, and the electro-optic element are connected in series between the first reference potential and second reference potential.

Preferably, it further comprises second, third, and fourth control lines, the first switch is controlled in conduction by the second control line, the second switch is controlled in conduction by the third control line, and the fourth switch is controlled in conduction by the fourth control line.

Preferably, the third control line and fourth control line are shared, and the second switch and fourth switch are controlled in conduction by one control line.

Preferably, when the electro-optic element is driven, as a first stage, the second switch and the fourth switch are made conductive for a predetermined time to electrically connect the first node and the second node, then the reference current is supplied to the first node, and as a second stage, the second switch and the fourth switch are held in the non-conductive state after an elapse of the predetermined time, and as a third stage, the third switch is made conductive by the first control line, the first switch is made conductive, and the data propagated through the data line is written into the third node, then the third switch is held in the non-conductive state and a current in accordance with the data signal is supplied to the electro-optic element.

Further, preferably, the current of the reference current is set at a value corresponding to an intermediate color of the light emission of the electro-optic element.

According to a second aspect of the present invention, there is provided a display device comprising a plurality of pixel circuits arranged in a matrix; a data line laid for every column of the matrix array of the pixel circuits. and supplied with a data signal in accordance with the luminance information; a first control line laid for every row of the matrix array of the pixel circuit; first and second reference potentials; and a reference current supplying means for supplying a predetermined reference current, wherein each pixel circuit has first, second, and third nodes, a drive transistor for forming a current supply line between the first terminal and the second terminal connected to the first node and controlling the current flowing through the current supply line in accordance with the potential of the control terminal connected to the second node, a first switch connected to the first node, a second switch connected between the first node and the second node, a third switch connected between the data line and the third node and controlled in conduction by the first control line, a fourth switch connected between the first node and the reference current supplying means, and a coupling capacitor connected between the second node and the third node, and the current supply line of the drive transistor, the first node, the first switch, and the electro-optic element are connected in series between the first reference potential and second reference potential.

Preferably, the reference current supplying means includes a reference current source and a reference current supply line laid for every column of the matrix array of the pixel circuits and supplied with the reference current from the reference current source, and the fourth switch is connected between the first node and the reference current supply line.

Preferably, the reference current supplying means includes a reference current source and a plurality of reference current supply lines laid for every column of the matrix array of the pixel circuits and supplied with the reference current from the reference current source, and the plurality of pixel circuits of the same column are connected to different reference current supply lines via the fourth switch.

Preferably, the device further has a reference voltage supplying means for selectively supplying a predetermined reference voltage to the reference current supply line.

Preferably, the reference voltage supplying means further has a reference voltage source and a switch circuit selectively connecting the reference current source and the reference voltage source to the reference current supply line.

Preferably, when the electro-optic element is driven, as a first stage, the second switch and the fourth switch are made conductive for a predetermined time to electrically connect the first node and the second node, then the reference current is supplied to the first node, as a second stage, the second switch and the fourth switch are held in the non-conductive state after an elapse of a horizontal scanning period, and as a third stage, the third switch is made conductive by the first control line, the first switch is made conductive and the data propagated through the data line is written into the third node, then the third switch is held in the non-conductive state and a current in accordance with the data signal is supplied to the electro-optic element.

Preferably, when the electro-optic element is driven, as a first stage, the second switch and the fourth switch are made conductive for a predetermined time to electrically connect the first node and the second node, then the reference current is supplied to the first node, as a second stage, the second switch and the fourth switch are held in the non-conductive state after an elapse of a time of a few times the horizontal scanning period, and as a third stage, the third switch is made conductive by the first control line, the first switch is made conductive, and the data propagated through the data line is written into the third node, then the third switch is held in the non-conductive state and a current in accordance with the data signal is supplied to the electro-optic element.

Preferably, where the electro-optic element is driven, as a first stage, the reference current supply line is precharged by the supply of the reference voltage by the reference voltage supplying means, as a second stage, the second switch and the fourth switch are made conductive for a predetermined time to electrically connect the first node and the second node, then supply the reference current to the first node, as a third stage, the second switch and the third switch are held in the non-conductive state by the third control line after an elapse of the horizontal scanning period, and as a fourth stage, the third switch is made conductive by the first control line, the first switch is made conductive, and the data propagated through the data line is written into the third node, then the third switch is held in the non-conductive state and a current in accordance with the data signal is supplied to the electro-optic element.

Preferably, the value of the reference current is set to a value corresponding to an intermediate color of the light emission of the electro-optic element.

Preferably, the value of the reference voltage is set to an intermediate value of the variation of the threshold value of the drive transistor.

According to a third aspect of the present invention, there is provided a display device comprising a plurality of pixel circuits arranged in a matrix; a data line laid for every column of the matrix array of the pixel circuits and supplied with a data signal in accordance with luminance information; a first control line laid for every row of the matrix array of the pixel circuits; and first and second reference potentials, wherein each pixel circuit has a reference current supplying means for supplying a predetermined reference current, first, second, and third nodes, a drive transistor for forming a current supply line between the first terminal and the second terminal connected to the first node and controlling the current flowing through the current supply line in accordance with the potential of the control terminal connected to the second node, a first switch connected to the first node, a second switch connected between the first node and the second node, a third switch connected between the data line and the third node and controlled in conduction by the first control line, a fourth switch connected between the first node and the reference current supplying means, and a coupling capacitor connected between the second node and the third node, and the current supply line of the drive transistor, the first node, the first switch, and the electro-optic element are connected in series between the first reference potential and second reference. potential.

According to a fourth aspect of the present invention, there is provided a driving method of a pixel circuit having an electro-optic element with a luminance changing according to the flowing current, a data line supplied with the data signal in accordance with luminance information, first, second, and third nodes, a reference current supplying means for supplying a predetermined reference current, a drive transistor for forming a current supply line between the first terminal and the second terminal connected to the first node and controlling the current flowing through the current supply line in accordance with the potential of the control terminal connected to the second node, a first switch connected to the first node, a second switch connected between the first node and the second node, a third switch connected between the data line and the third node and controlled in conduction by the first control line, a fourth switch connected between the first node and the reference current supplying means, and a coupling capacitor connected between the second node and the third node, and the current supply line of the drive transistor, the first node, the first switch, and the electro-optic element are connected in series between the first reference potential and second reference potential, comprising making the second switch and the fourth switch conductive for a predetermined time to electrically connect the first node and the second node and supplying a reference current to the first node, holding the second switch and the third switch in the non-conductive state after the elapse of a predetermined time, making the third switch conductive, making the first switch conductive, and writing data propagated through the data line into the third node, then holding the third switch in the non-conductive state and supplying current in accordance with the data signal to the electro-optic element.

According to the present invention, for example the reference current flows through the reference current supply line by a constant current source. Then, the second switch and the fourth switch are held in the conductive state. At this time, the second switch and the fourth switch turn on, the first node and the second node are connected to the reference current source through the reference current supply line, and the reference current is drawn, therefore the gate voltage value of the drive transistor is set so that the on current of the pixel coincides with the reference current. Due to this, correction (auto-zero operation) with respect to all pixels having variations of the threshold value and mobility $\mu$ is executed. Next, the second and fourth switches are made to the non-conductive state to end the auto-zero operation (Vth correction operation), then for example the first switch is made the conductive state. Further, the third switch is made the conductive state by the first control line, and a data signal having the predetermined potential propagated through the data line is supplied to the coupling capacitor. Due to this, the input data signal is coupled with the gate voltage of the drive transistor via the coupling capacitor, and a current having a value corresponding to the coupling voltage $\Delta V$ flows through the electro-optic element to cause it to emit light. Then, the third switch is made the non-conductive state.

BRIEF DESCRIPTION OF THE DRAWINGS

These and other objects and features of the present invention will become clearer from the following description of the preferred embodiments given with reference to the accompanying drawings, in which:

FIGS. 19A to 19G are timing charts for explaining the operation of the fourth embodiment;

DESCRIPTION OF THE PREFERRED EMBODIMENTS

Below, preferred embodiments of the present invention will be described with reference to the accompanying drawings.

First Embodiment

Figure 8:
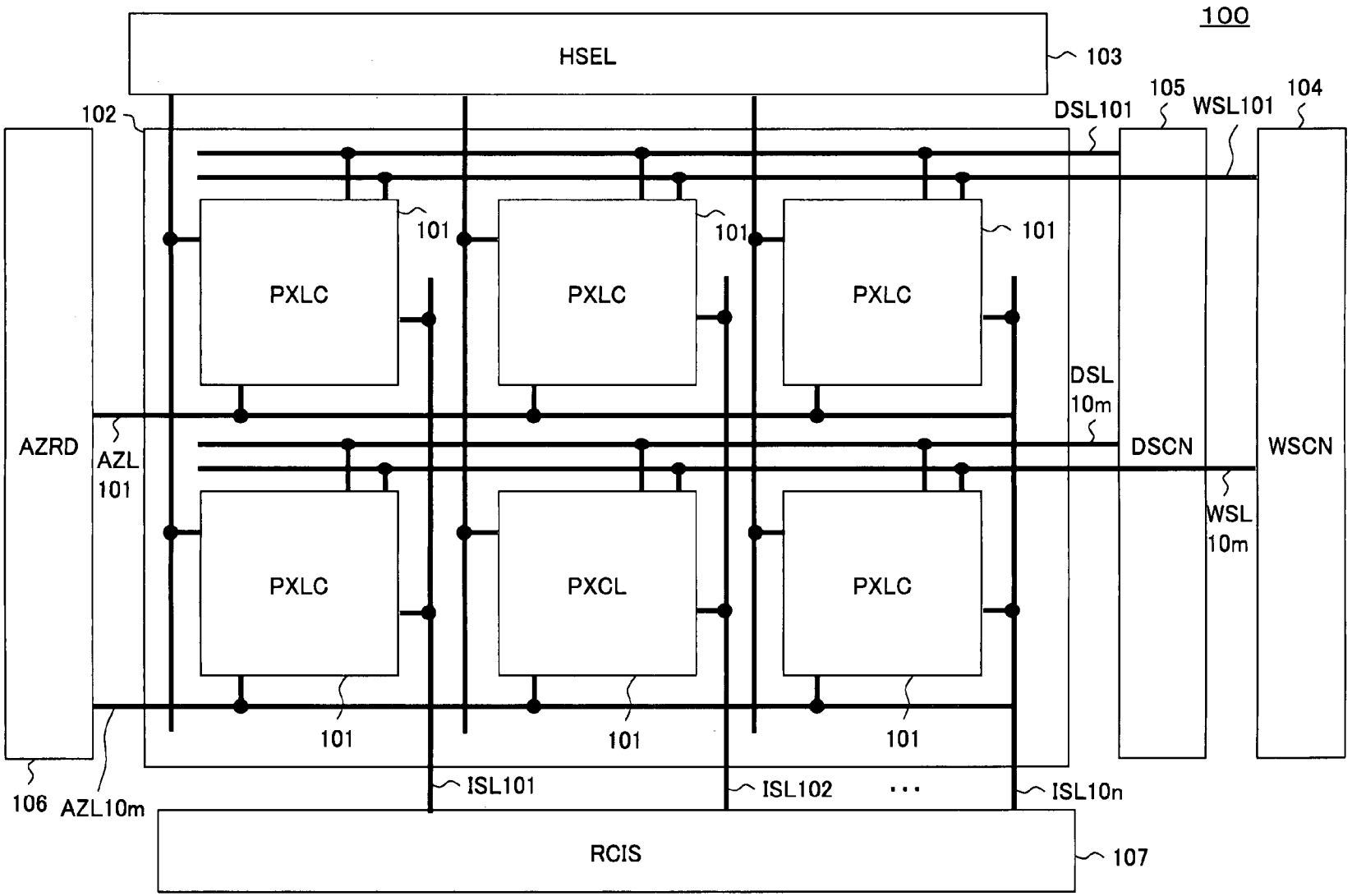
FIG. 8 is a block diagram of the configuration of an organic EL display device employing pixel circuits according to a first embodiment.
Figure 9:
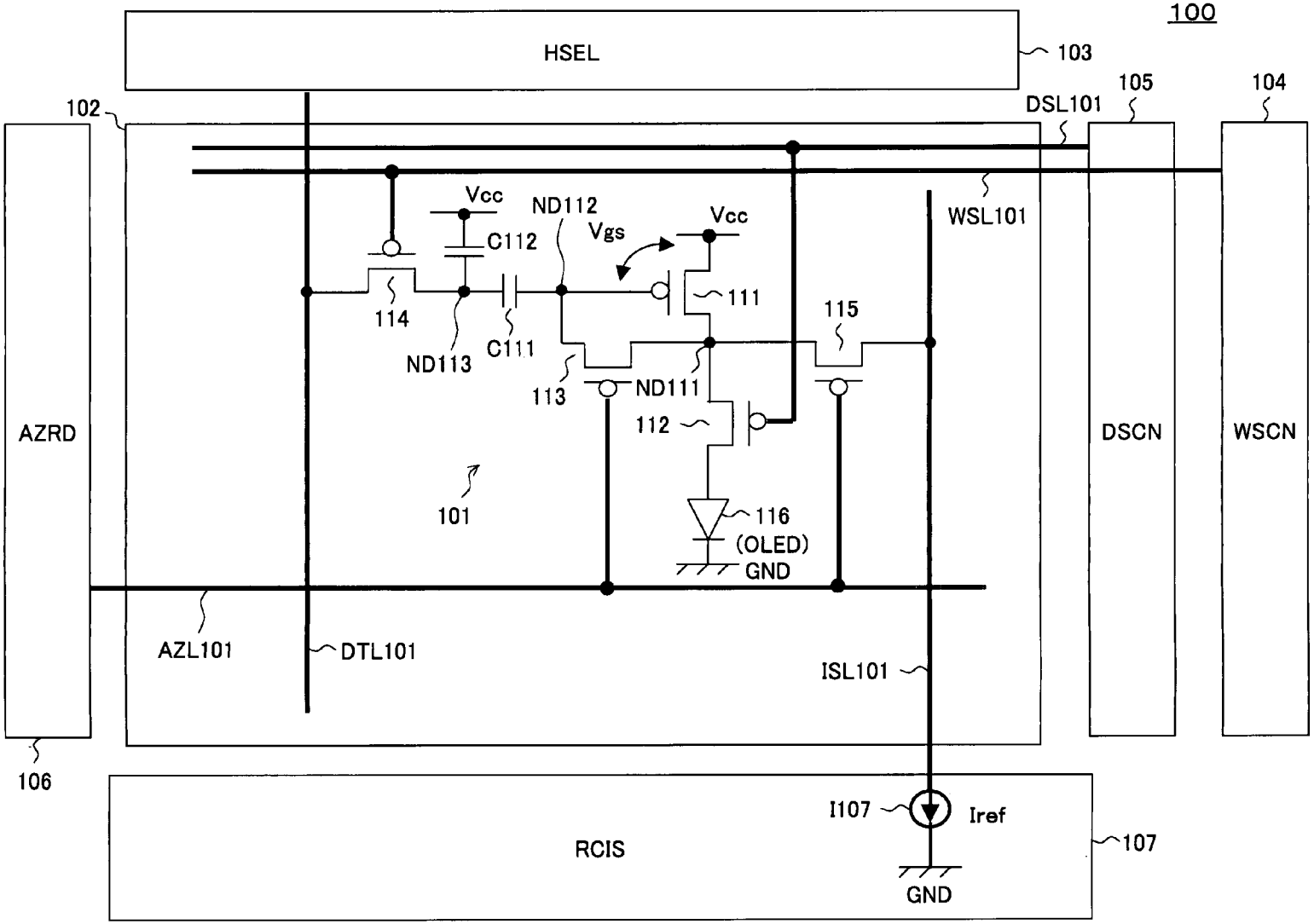
FIG. 9 is a circuit diagram of a concrete configuration of a pixel circuit according to the first embodiment in the organic EL display device of FIG. 8.

FIG. 8 is a block diagram of the configuration of an organic EL display device employing pixel circuits according to the first embodiment. FIG. 9 is a circuit diagram of the concrete configuration of a pixel circuit according to the first embodiment in the organic EL display device of FIG. 8.

This display device 100 has, as shown in FIG. 8 and FIG. 9, a pixel array portion 102 having pixel circuits (PXLC) 101 arranged in an m×n matrix, a horizontal selector (HSEL) 103, a write scanner (WSCN) 104, a drive scanner (DSCN) 105, an auto-zero circuit (AZRD) 106, a reference constant current source (RCIS) 107, data lines DTL101 to DTL10*n* selected by the horizontal selector 103 and supplied with a data signal in accordance with the luminance information, scanning lines WSL101 to WSL10*m* selectively driven by the write scanner 104, drive lines DSL101 to DSL10*m* selectively driven by the drive scanner 105, auto-zero lines AZL101 to AZL10*m* selectively driven by the auto-zero circuit 106, and reference current supply lines ISL101 to ISL10*n* supplied with the reference current by the constant current source (RCIS) 107.

Note that while the pixel circuits 101 are arranged in an m×n matrix in the pixel array portion 102, FIG. 8 shows an example wherein the pixel circuits are arranged in a 2(=m)×3(=n) matrix for the simplification of the drawing. Further, in FIG. 9, the concrete configuration of one pixel circuit is shown for simplification of the drawing.

The pixel circuit 101 according to the first embodiment has, as shown in FIG. 9, a p-channel TFT 111 to TFT 115, capacitors C111 and C112, a light emitting diode 116 made of an organic EL element (OLED), a first node ND111, a second node ND112, and a third node ND113. Further, in FIG. 9, DTL101 indicates a data line, WSL101 indicates a scanning line, DSL101 indicates a drive line, and AZL101 indicates an auto-zero line. Among these constituent elements, TFT 111 configures the drive transistor according to the present invention, TFT 112 configures the first switch, TFT 113 configures the second switch, TFT 114 configures the third switch, TFT 115 configures the fourth switch, and the capacitor C111 configures the coupling capacitor according to the present invention.

Further, the current supplying means is configured by the current source I107 and the reference current supply line ISL101. A reference current Iref (for example 2 μA) is passed through the reference current supply line ISL101. The reference current Iref is set at a current value corresponding to an intermediate color of the emitted light of the light emitting element 116 so as to be able to correct also the variation of the mobility. Further, the scanning line WSL101 corresponds to the first control line according to the present invention, the drive line DSL101 corresponds to the second control line, and the auto-zero line AZL101 corresponds to the third control line (and the fourth control line). Further, the supply line (power supply potential) of the power supply voltage VCC corresponds to the first reference potential, and the ground potential GND corresponds to the second reference potential.

In the pixel circuit 101, the TFT 111, the first node ND111, the TFT 112, and the light emitting element 116 are connected in series between the power supply voltage VCC and the ground potential GND. Concretely, a source of the TFT 111 serving as the drive transistor is connected to the supply line of the power supply voltage VCC, and a drain is connected to the first node ND111. A source of the TFT 112 serving as the first switch is connected to the first node ND111, a drain is connected to an anode of the light emitting element 116, and a cathode of the light emitting element 116 is connected to the ground potential GND. A gate of the TFT 111 is connected to the second node ND112, and a gate of the TFT 112 is connected to the drive line DSL101 serving as the second control line. The source and the drain of the TFT 113 serving as the second switch are connected to the first node ND111 and the second node ND112, and a gate of the TFT 113 is connected to the auto-zero line AZL101 serving as the third control line. A first electrode of the capacitor C111 is connected to the second node ND112, and a second electrode is connected to the third node ND113.

Further, a first electrode of the capacitor C112 is connected to the third node ND113, and a second electrode is connected to the power supply voltage VCC. The source and the drain of the TFT 114 serving as the third switch are connected to the data line DTL101 and the third node ND113, and a gate of the TFT 114 is connected to the scanning line 101 serving as the first control line. Further, the source and the drain of the TFT 115 serving as the fourth switch are connected to the first node ND111 and the reference current supply line ISL101, and a gate of the TFT 115 is connected to the auto-zero line AZL101 serving as the third control line.

Figure 10:
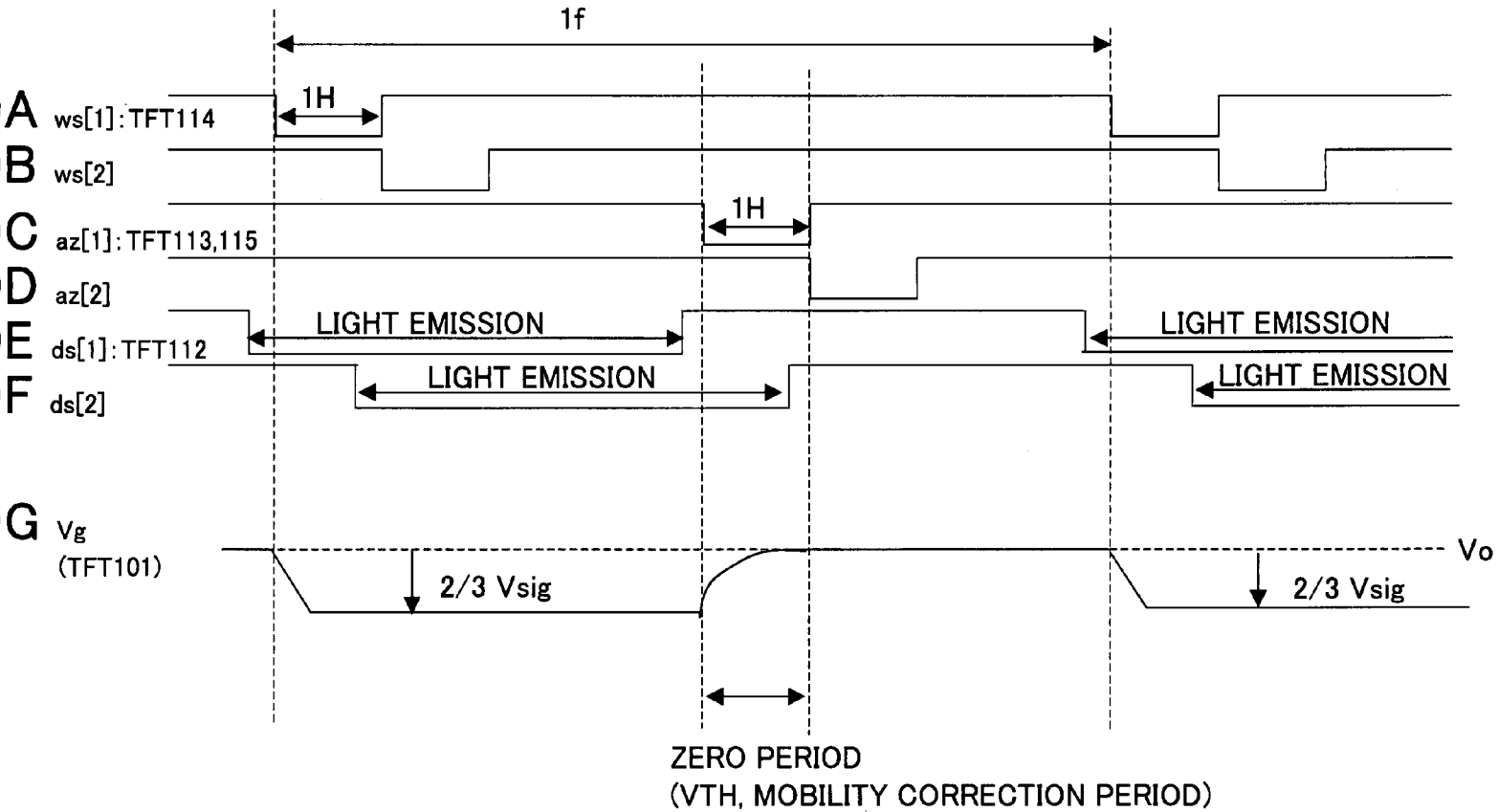
FIGS. 10A to 10G are timing charts for explaining the operation of the first embodiment.

Next, the operation of the above configuration will be explained in relation to FIGS. 10A to 10G focusing on the operation of a pixel circuit. FIG. 10A shows the scanning signal ws[1] supplied to the scanning line WSL101 of the first row of the pixel array; FIG. 10B shows the scanning signal ws[2] supplied to the scanning line WSL102 of the second row of the pixel array, FIG. 10C shows the auto-zero signal az[1] supplied to the auto-zero line AZL101 of the first row of the pixel array; FIG. 10D shows the auto-zero signal az[2] supplied to the auto-zero line AZL102 of the second row of the pixel array; FIG. 10E shows the drive signal ds[1] supplied to the drive line DSL101 of the first row of the pixel array; FIG. 10F shows the drive signal ds[2] supplied to the drive line DSL102 of the second row of the pixel array; and FIG. 10G shows the gate potential Vg of the TFT 111. Further, Vo indicates the gate voltage value of the drive transistor TFT 111 for carrying the reference current Iref. Note that, the operation of the pixel circuit of the first row will be explained below.

First, the reference current Iref (for example 2 μA) flows through the reference current supply line ISL101 from the constant current source 107. As shown in FIGS. 10C and 10E, in the state where the drive signal ds[1] to the drive line DSL101 is the high level (the TFT 112 is in the non-conductive state), the auto-zero signal az[1] to the auto-zero line AZL101 is made the low level, and the TFT 113 and the TFT 115 are made the conductive state.

At this time, the TFT 115 turns on, the first node ND111 and the second node ND112 are connected to the reference current source I107 through the reference current supply line ISL101, and the reference current Iref is drawn, therefore, as shown in FIG. 10G, the gate voltage value Vo of the drive transistor TFT 111 is set so that the on current of the pixel coincides with the reference current Iref. Due to this, correction (auto-zero operation) with respect to all pixels having variable threshold values and mobilities is executed.

As shown in FIG. 10C, after making the auto-zero signal az[1] to the auto-zero line AZL101 the high level and making the TFT 113 and TFT 115 the non-conductive state to end the auto-zero operation (Vth correction operation), as shown in FIG. 10E, the drive signal ds[1] to the drive line DSL1 is made the low level, and the TFT 112 is made the conductive state.

Then, the scanning signal ws[1] to the scanning line WSL101 is made the low level as shown in FIG. 10A to make the TFT 114 the conductive state and a data signal having a predetermined potential propagated through the data line DTL101 is supplied to the capacitor C111. Due to this, as shown in FIG. 10G, the input data signal is coupled with the gate voltage of the TFT 111 via the capacitor C111, and a current Ids having a value corresponding to the coupling voltage ΔV flows through the EL light emitting element 116 to cause it to emit light. Then, as shown in FIG. 10A, the scanning line WSL101 is made the high level to make the TFT 114 the non-conductive state.

Figure 11:
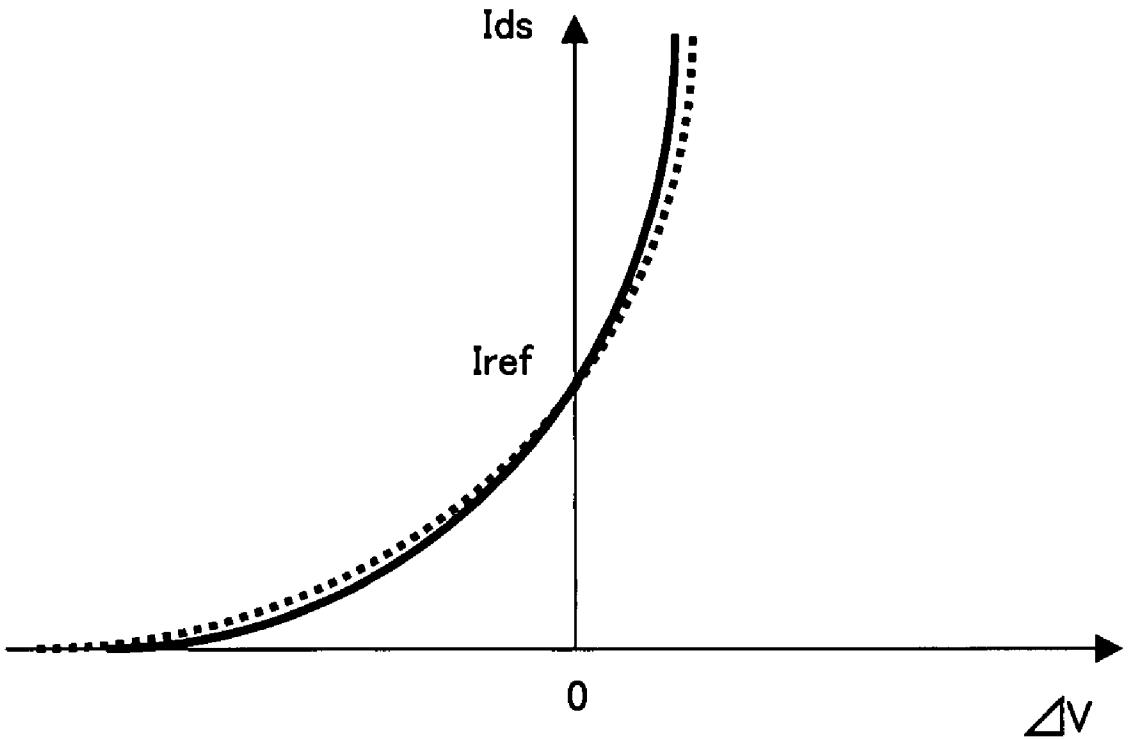
FIG. 11 is a graph showing characteristic curves of ΔV (=Vgs−Vth) and a drain-source current Ids in the pixel circuit of FIG. 9 for drive transistors having different mobilities.

FIG. 11 is a graph showing characteristic curves of ΔV (=Vgs−Vth) and the drain-source current Ids in the pixel circuit of FIG. 9 for drive transistors having different mobilities. In FIG. 11, the abscissa represents the voltage ΔV, and the ordinate represents the current Ids. Further, in FIG. 11, the curve indicated by the solid line indicates the characteristic of the pixel A, and the curve indicated by the broken line indicates the characteristic of the pixel B.

Figure 1:
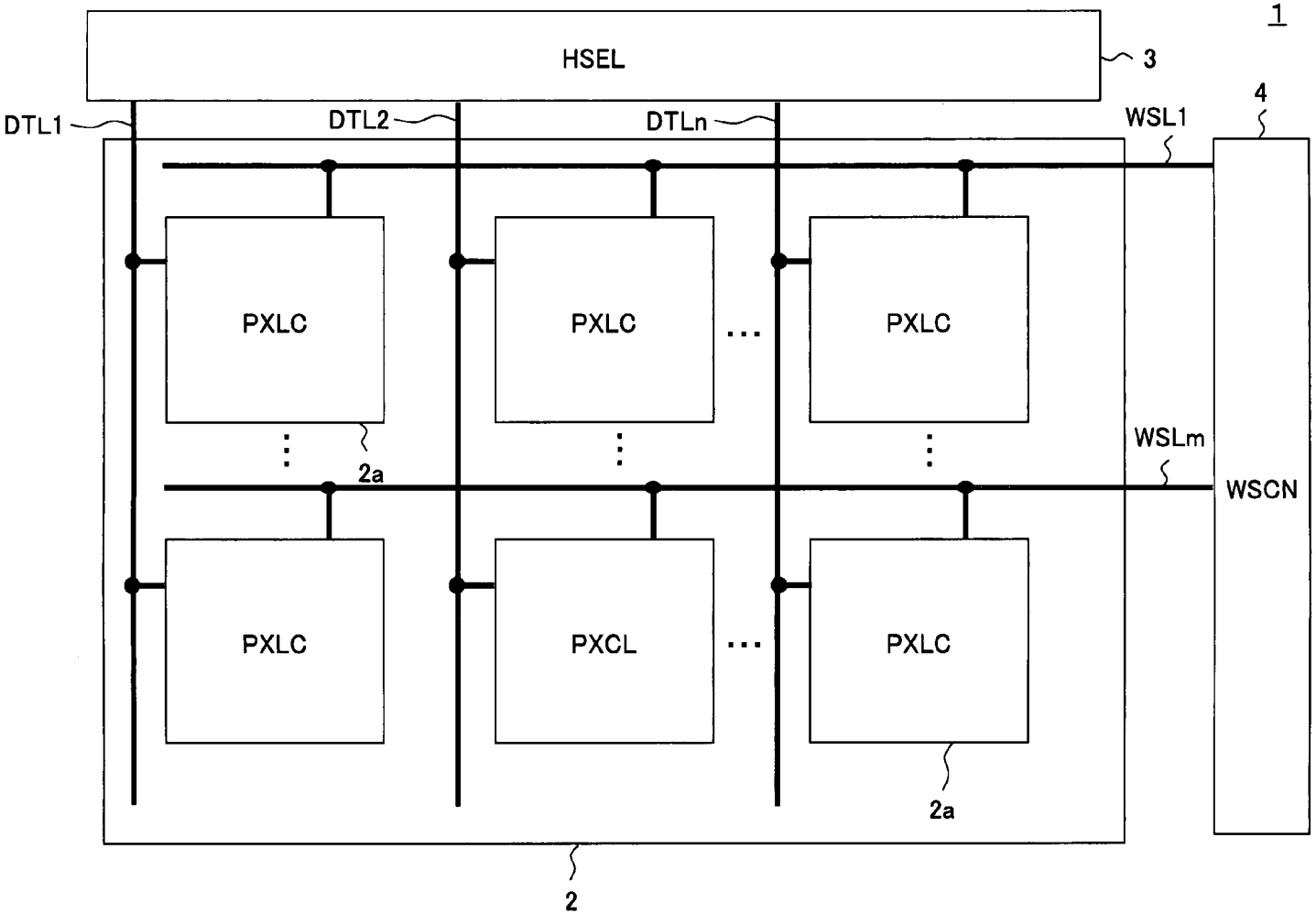
FIG. 1 is a block diagram of the configuration of a general organic EL display device.
Figure 2:
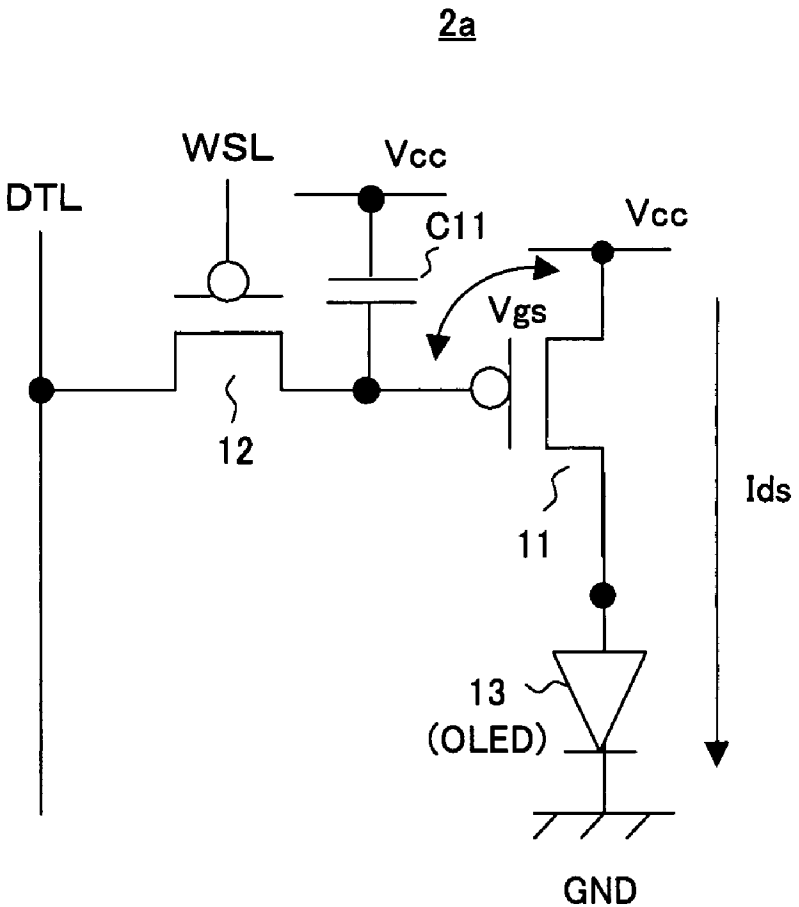
FIG. 2 is a circuit diagram of an example of the configuration of a pixel circuit of FIG. 1.
Figure 3:
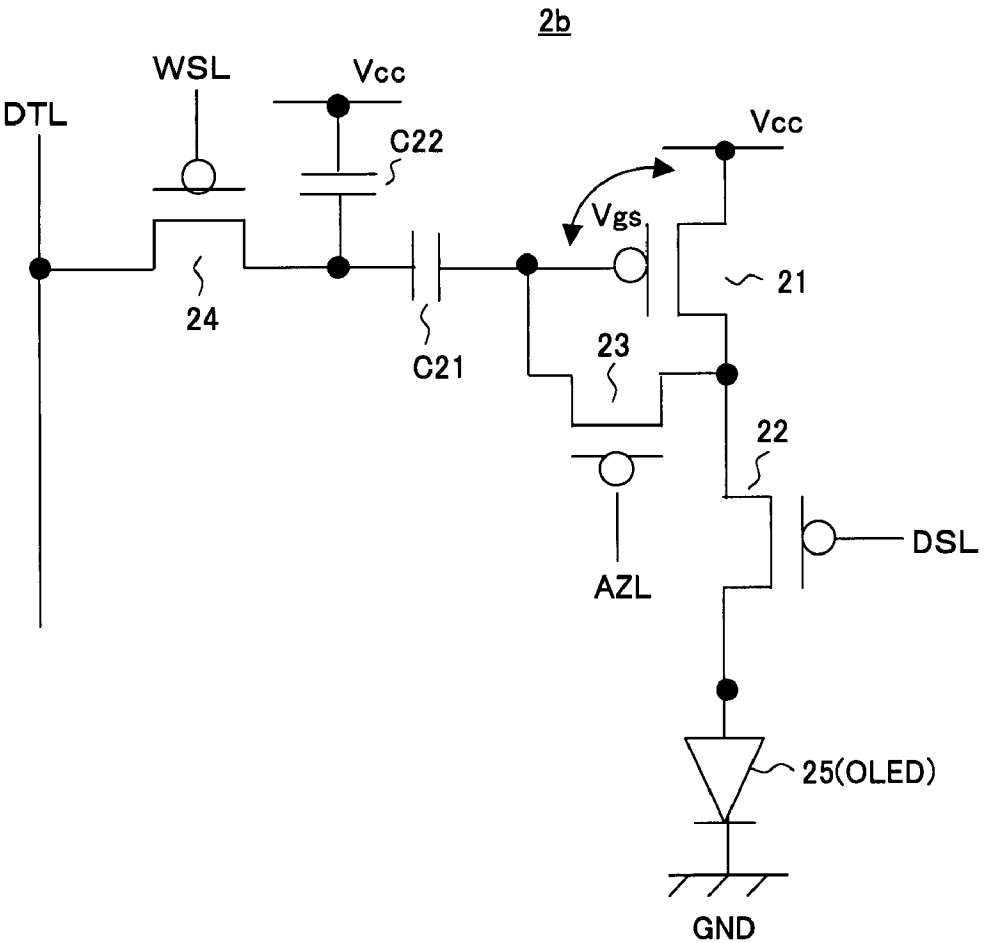
FIG. 3 is a circuit diagram of an example of the configuration of a pixel circuit having an auto-zero function.
Figure 4:
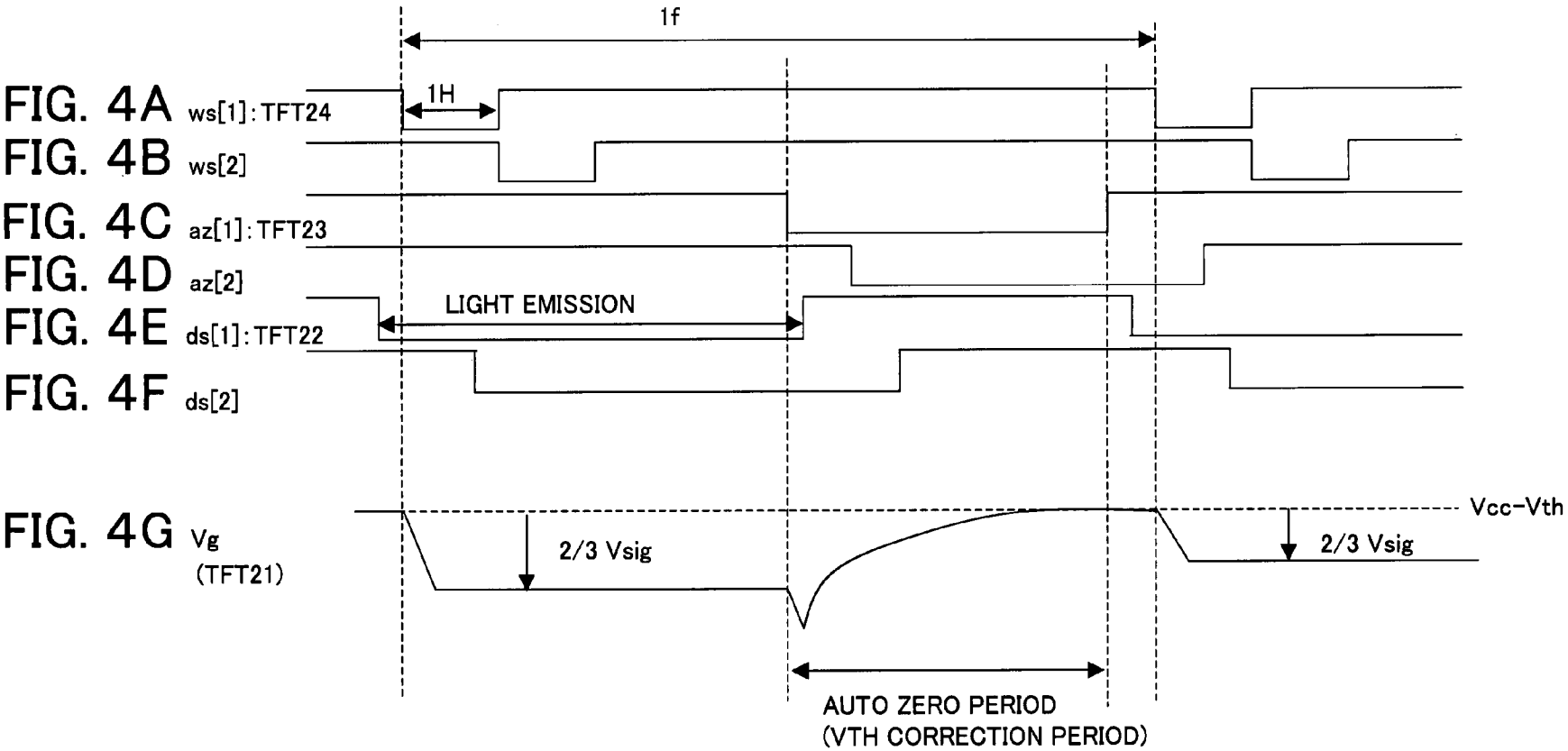
FIGS. 4A to 4G are timing charts for explaining the operation of the circuit of FIG. 3.
Figure 5:
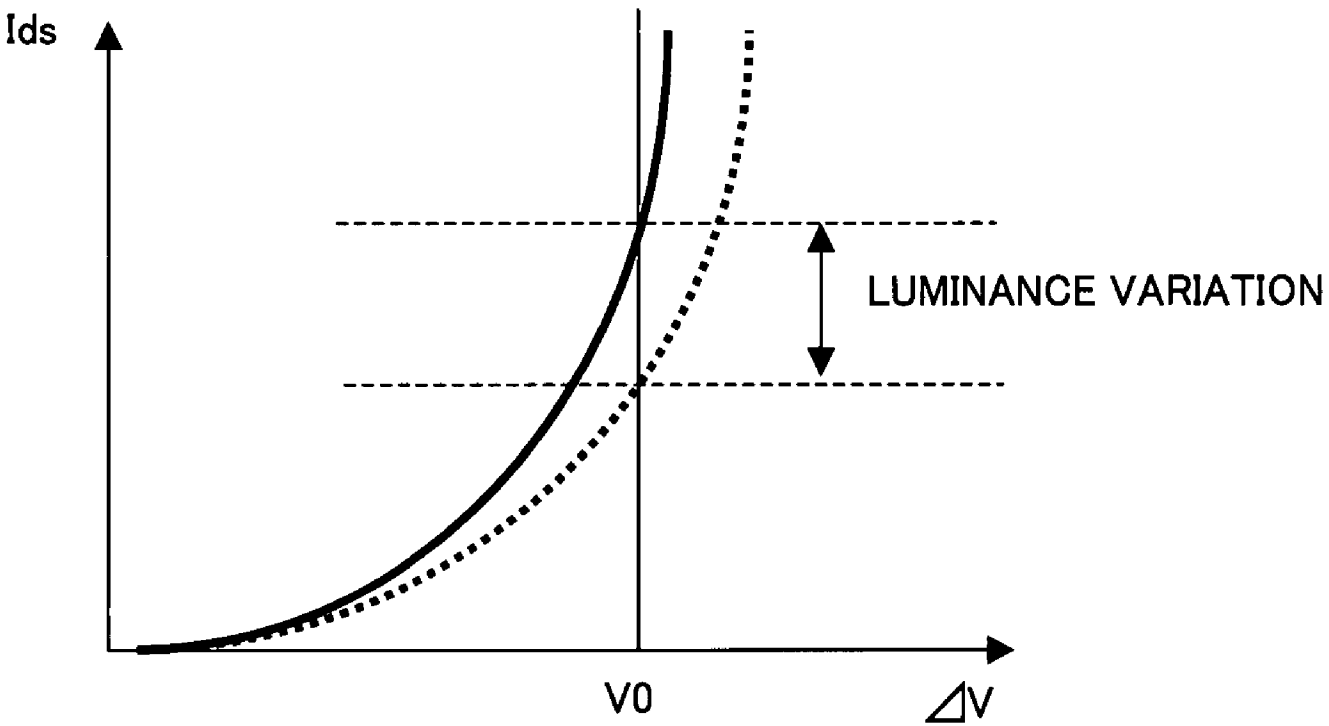
FIG. 5 is a graph of the characteristic curve of $\Delta V$. (=Vgs−Vth) of drive transistors having different mobilities and the drain-source current Ids in the pixel circuit of FIG. 3.
Figure 6:
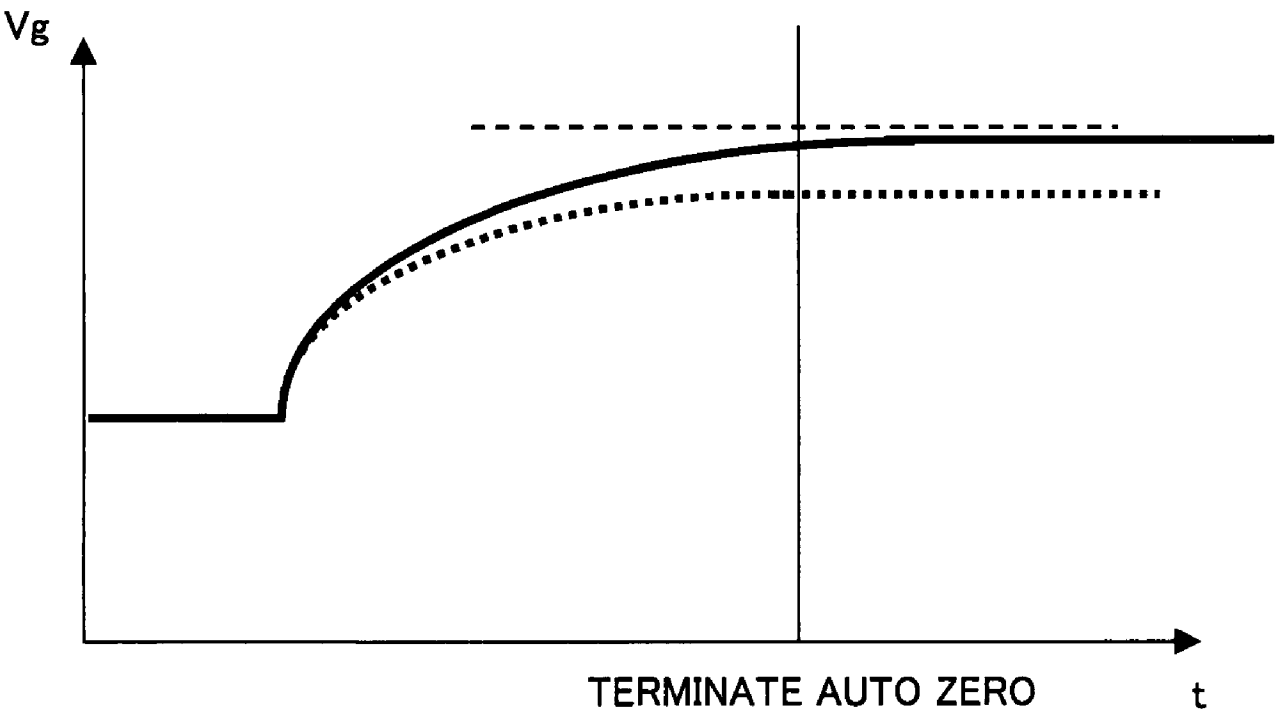
FIG. 6 is a graph of the change of the gate voltage of the drive transistor at the time of the auto-zero operation in pixels having different threshold values Vth of the drive transistor.
Figure 7:
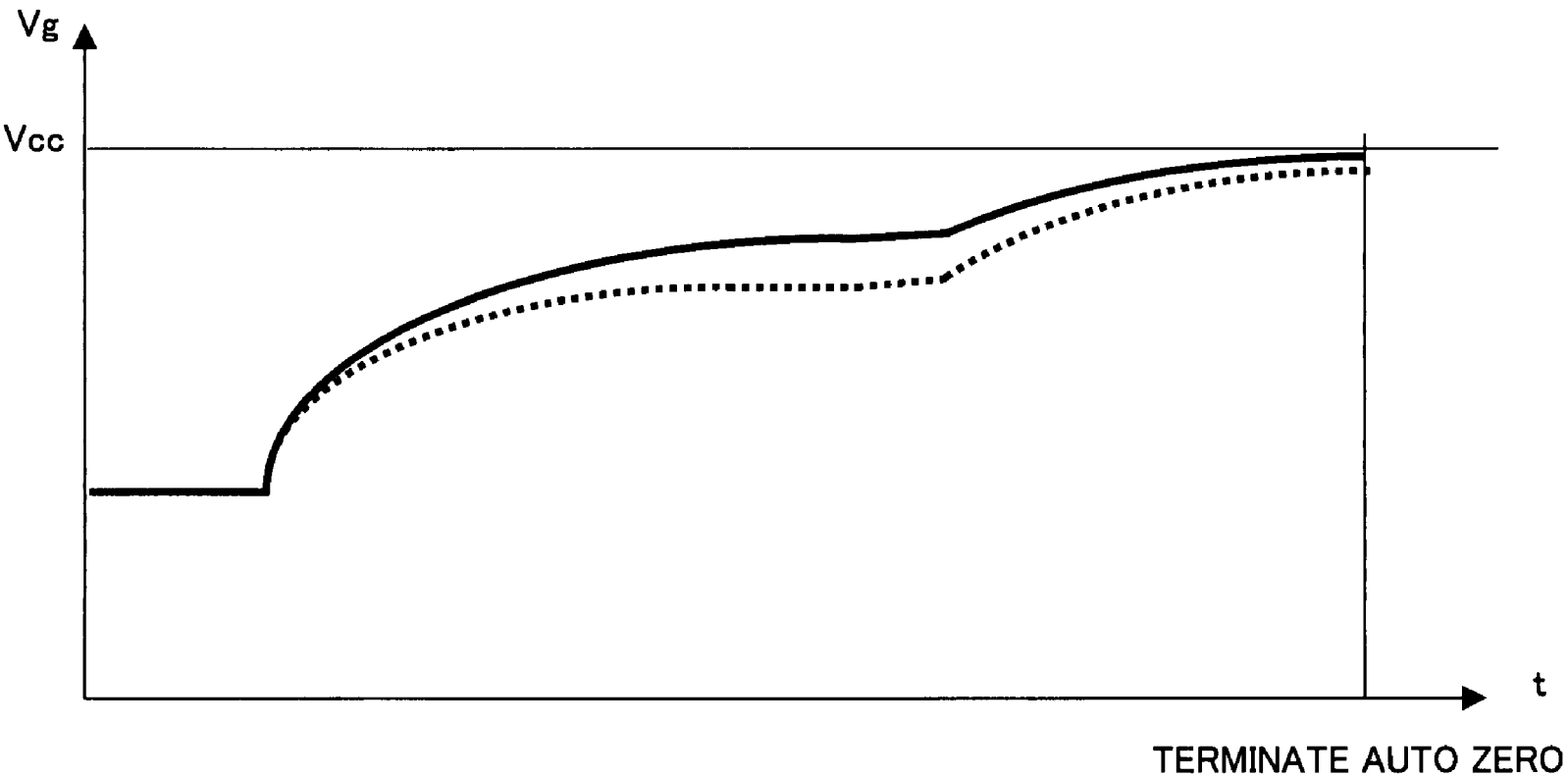
FIG. 7 is a view for explaining the problem of the circuit of FIG. 3.

As shown in FIG. 11, in the present pixel circuit, at the time of correction of variation (ΔV=0) as explained above, even with pixels having different threshold values Vth and mobilities μ, the reference current Iref flows through the drive transistor TFT 111. Thereafter, an on current corresponding to the coupling voltage ΔV flows. The present pixel circuit is equivalent to a circuit obtained by moving the graph (FIG. 5) with a different mobility in the conventional method in parallel and making it cross at the current value Iref. That is, variation of the mobility μ arises centered on the reference current Iref. Therefore, as shown in FIG. 11, the variation of the on current due to the variation of mobility at the time of a white display is suppressed. Due to this, it becomes able to obtain an organic EL panel having a better uniformity.

Figure 12:
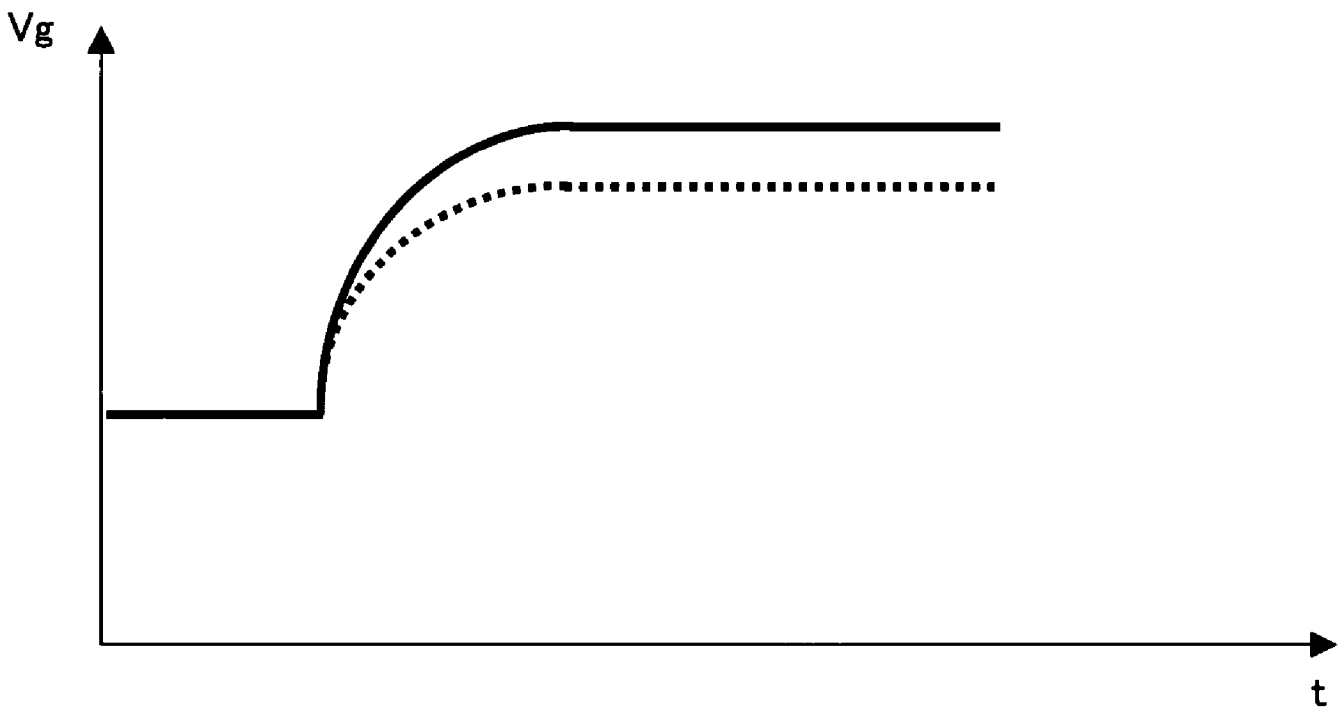
FIG. 12 is a graph showing changes of gate voltages of the drive transistors at a time of an auto-zero operation in pixels having different threshold values Vth of the drive transistors in the pixel circuit of FIG. 9.

Further, FIG. 12 is graph showing the changes of the gate voltages of drive transistors at the time of the auto-zero operation at pixels C and D having different threshold values Vth of the drive transistors. In FIG. 12, the abscissa represents the time t, and the ordinate represents the gate voltage Vg. Further, in FIG. 12, the curve indicated by the solid line indicates the characteristic of the pixel C, and the curve indicated by the broken line represents the characteristic of the pixel D.

As explained above, in the present pixel circuit, the gate potential Vg of the TFT 111 is set so that the reference current Iref flows, and the variation of the threshold value Vth is cancelled. In this way, the variation of the threshold value Vth is cancelled while the reference current Iref is flowing as it is. Therefore, the time until the cancellation of the Vth variation can be made shorter in comparison with the conventional method, the cancellation of the variation of the threshold value Vth does not become incomplete, and variation of the uniformity does not occur. Further, even after canceling the variation of the threshold value Vth, the reference current Iref continuously flows so long as the TFT 115 is held in the conductive state, and as shown in FIG. 12, the gate voltage is continuously held. That is, in the present pixel circuit, since the gate voltage is continuously held, the gate voltage is held while the threshold value Vth is corrected as it is with respect to variation of the threshold value Vth. Due to this, even in panels having different threshold values Vth, correction of the threshold value Vth is carried out irrespective of the set time of the auto-zero operation. As a result, the uniformity is enhanced.

As explained above, according to the first embodiment, the reference current line is connected to the drive transistor of the pixel through the switch and variation of the threshold value Vth is corrected, so variation of the on current due to the mobility at the time of a so-called white display can be suppressed, and the uniformity with respect to variation in mobility can be enhanced considerably in comparison with the conventional method. Further, since variation of the threshold value Vth is cancelled by passing the reference current Iref, the time taken for cancellation of variation of the threshold value Vth is shortened in comparison with the conventional method, and the deterioration of uniformity due to variation of the threshold value Vth can be prevented.

Further, once the variation of the threshold value is cancelled, the gate potential does not fluctuate thereafter. Therefore, the time of the auto-zero operation does not depend upon the absolute value of the threshold value Vth, and the increase of the number of steps due to the setting of the auto-zero time can be suppressed.

Note that, in the present embodiment, an explanation was given of a configuration generating a reference current.in a so-called display panel as the reference current source, but it is also possible to configure the same so as to supply the reference current Iref from the outside of the panel. In this case, the reference current Iref is generated in for example an external MOSIC and input to the panel, so there is little variation of the current value for every reference current supply line.

Further, in the present embodiment, a configuration connecting the gate of the TFT 113 serving as the second switch and the gate of the TFT 115 serving as the fourth switch to the auto-zero line AZL101 serving as the third control line was employed, but it is also possible to configure the circuit so that the gate of the TFT 113 serving as the second switch is connected to the first auto-zero line AZL101-2 serving as the third control line, and the gate of the TFT 115 serving as the fourth switch is connected to the second auto-zero line AZL101-2 serving as the fourth control line. In this way, when the TFT 113 and TFT 115 are turned on by different control lines, the timing when they are turned on, that is, which is first or second, does not exert an influence upon the auto-zero operation. Note that since the drive pulse can be reduced, preferably they are turned on at the same timing by a common control line as in the present embodiment.

Further, in the present embodiment, the drive control is carried out so that the drive scanning and the auto-zero operation do not overlap, but it is also possible to overlap them. Overlap can prevent the cut-off of the drive transistor TFT 111 more. Further, in the present embodiment, the drive control is carried out so as to turn on the drive scanning before the write scanning, but they may be carried out simultaneously or the drive scanning may be carried out later too. When the drive scanning is turned on before the write scanning, at the time of writing the signal voltage, the drive transistor TFT 111 becomes a saturated drive state and the gate capacitance becomes small, so preferably the drive scanning is turned on before the write scanning.

Second Embodiment

Figure 13:
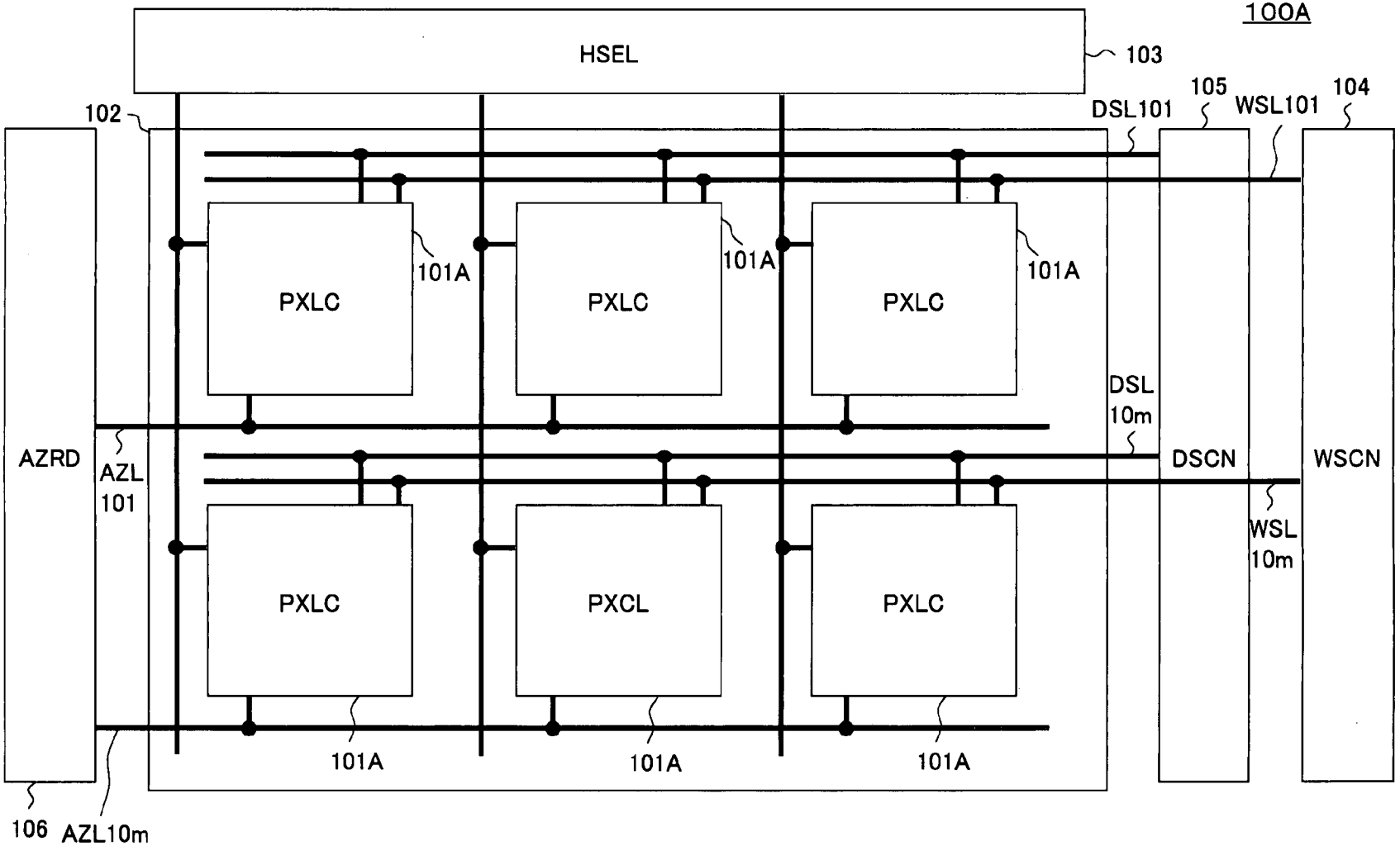
FIG. 13 is a block diagram of the configuration of an organic EL display device employing pixel circuits according to a second embodiment.
Figure 14:
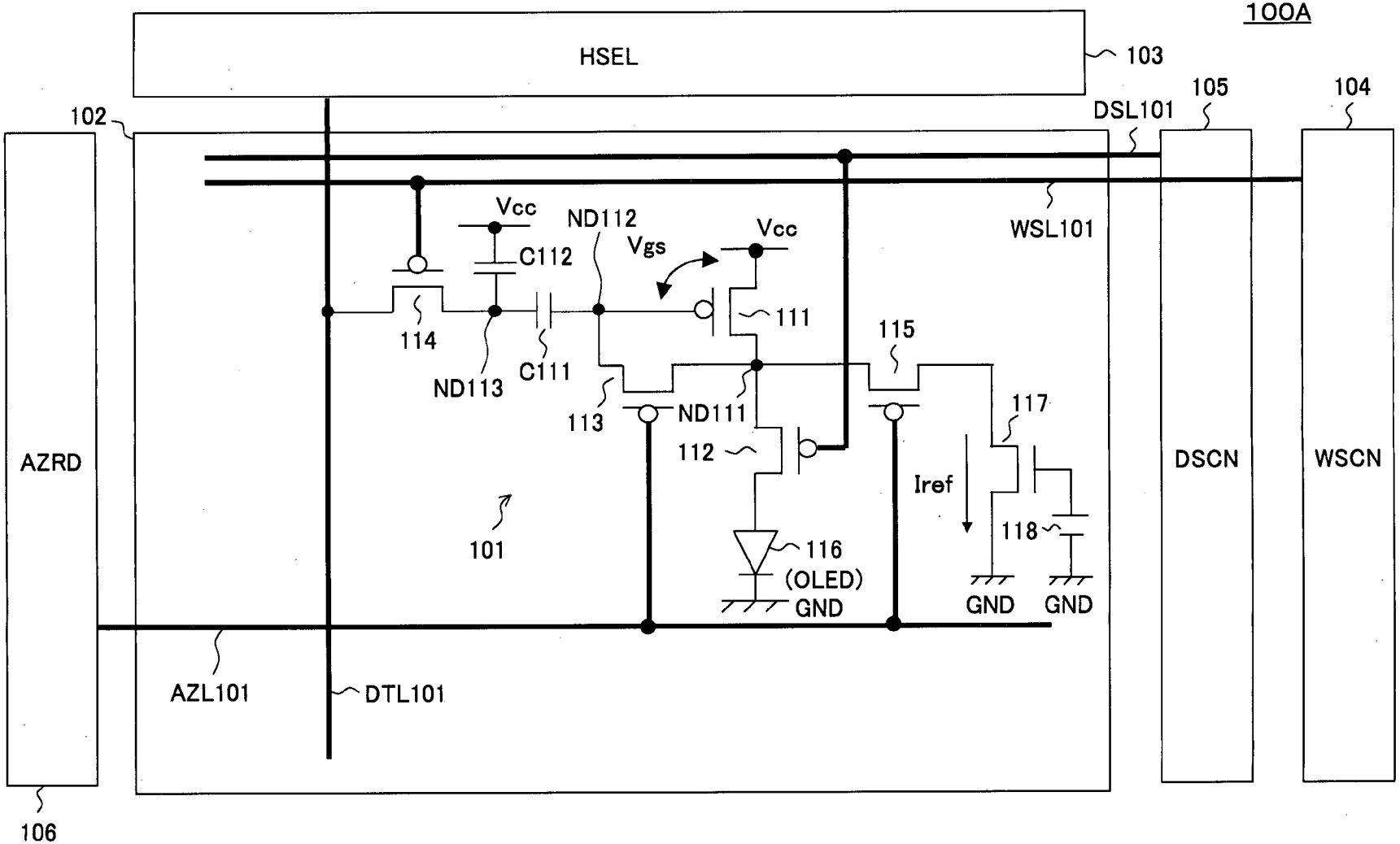
FIG. 14 is a circuit diagram of the concrete configuration of a pixel circuit according to the second embodiment in the organic EL display device of FIG. 13.

FIG. 13 is a block diagram of the configuration of an organic EL display device employing pixel circuits according to a second embodiment. FIG. 14 is a circuit diagram of the concrete configuration of a pixel circuit according to the second embodiment in the organic EL display device of FIG. 13.

The difference of the second embodiment from the first embodiment mentioned above resides in that, instead of a configuration wherein a reference constant current source (RCIS) 107 is provided, the reference current is passed through the reference current supply line, and the first node ND111 and the reference current supply line are connected by the TFT 115 of each pixel circuit, as shown in FIG. 14, the configuration was made so that the reference current was generated for every pixel circuit. Concretely, as shown in FIG. 14, in each pixel circuit 101A, an n-channel TFT 117 serving as the constant current source, and a constant voltage source 118 are provided. As a result, as shown in FIG. 13, the reference constant current source (RCIS) of FIG. 8 becomes unnecessary.

The first node ND111 and a drain of the TFT 117 are connected to the source and the drain of the TFT 115 serving as the fourth switch, while a source of the TFT 117 is connected to the ground potential GND. Further, a gate of the TFT 117 is connected to the constant voltage source 118. By supplying a low gate voltage to the TFT 117 from the constant voltage source 118 and simultaneously operating the same in the saturated region, this n-channel TFT 117 is used as a constant current source.

According to the second embodiment, in addition to the effects of the first embodiment, the effect that the number of input terminals can be greatly decreased in comparison with the time when the reference current supply line is drawn from the outside of the panel can be obtained.

Note that, in the present pixel circuit, there arises a problem with the threshold value Vth of the TFT 117. To avoid this as much as possible, for example, it is possible to reduce the source potential of the TFT 117 to a negative potential and enlarge the gate-source voltage Vgs of the TFT 117 to absorb the variation of the threshold value Vth.

Third Embodiment

Figure 15:
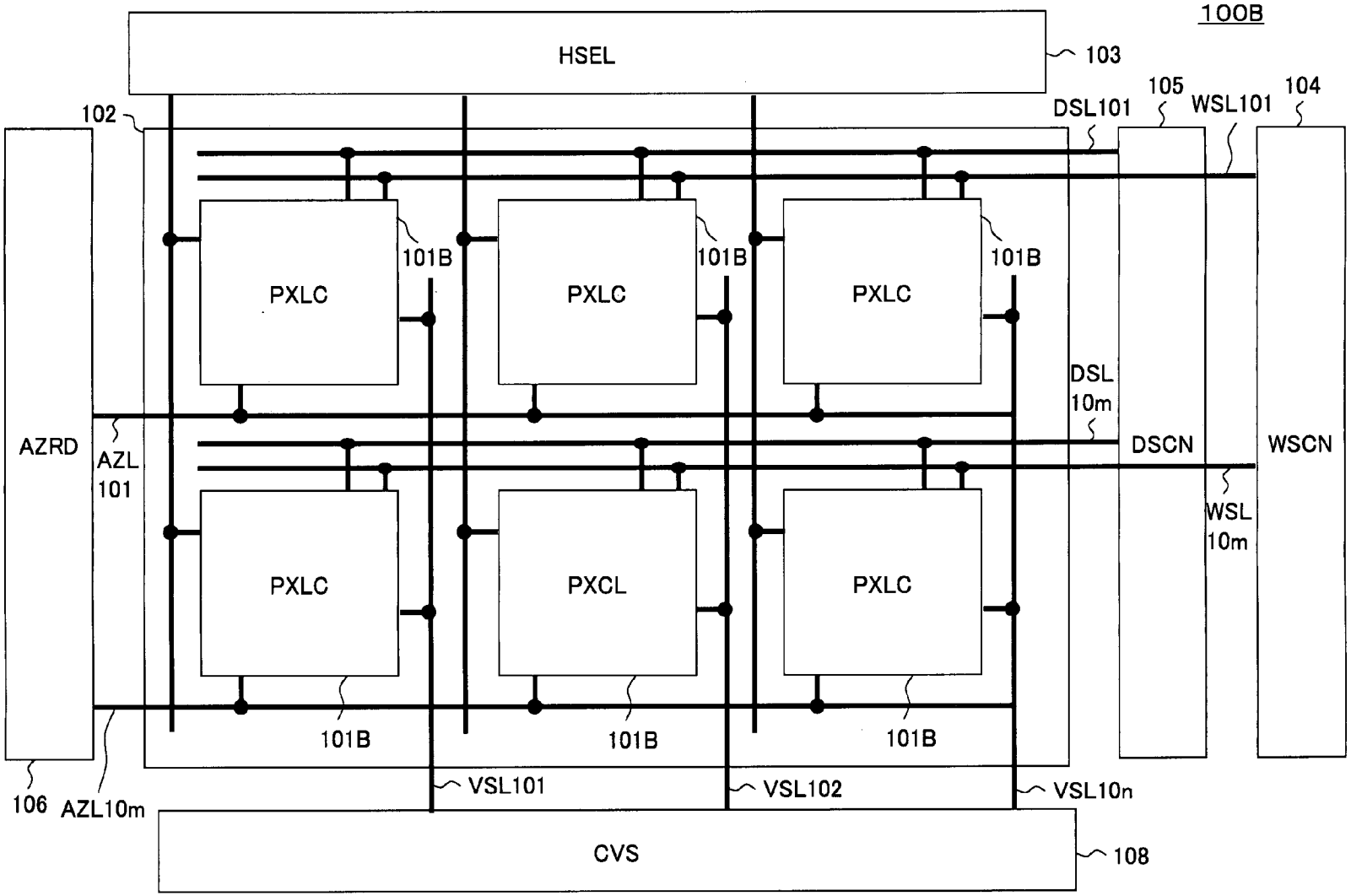
FIG. 15 is a block diagram of the configuration of an organic EL display device employing pixel circuits according to a third embodiment.
Figure 16:
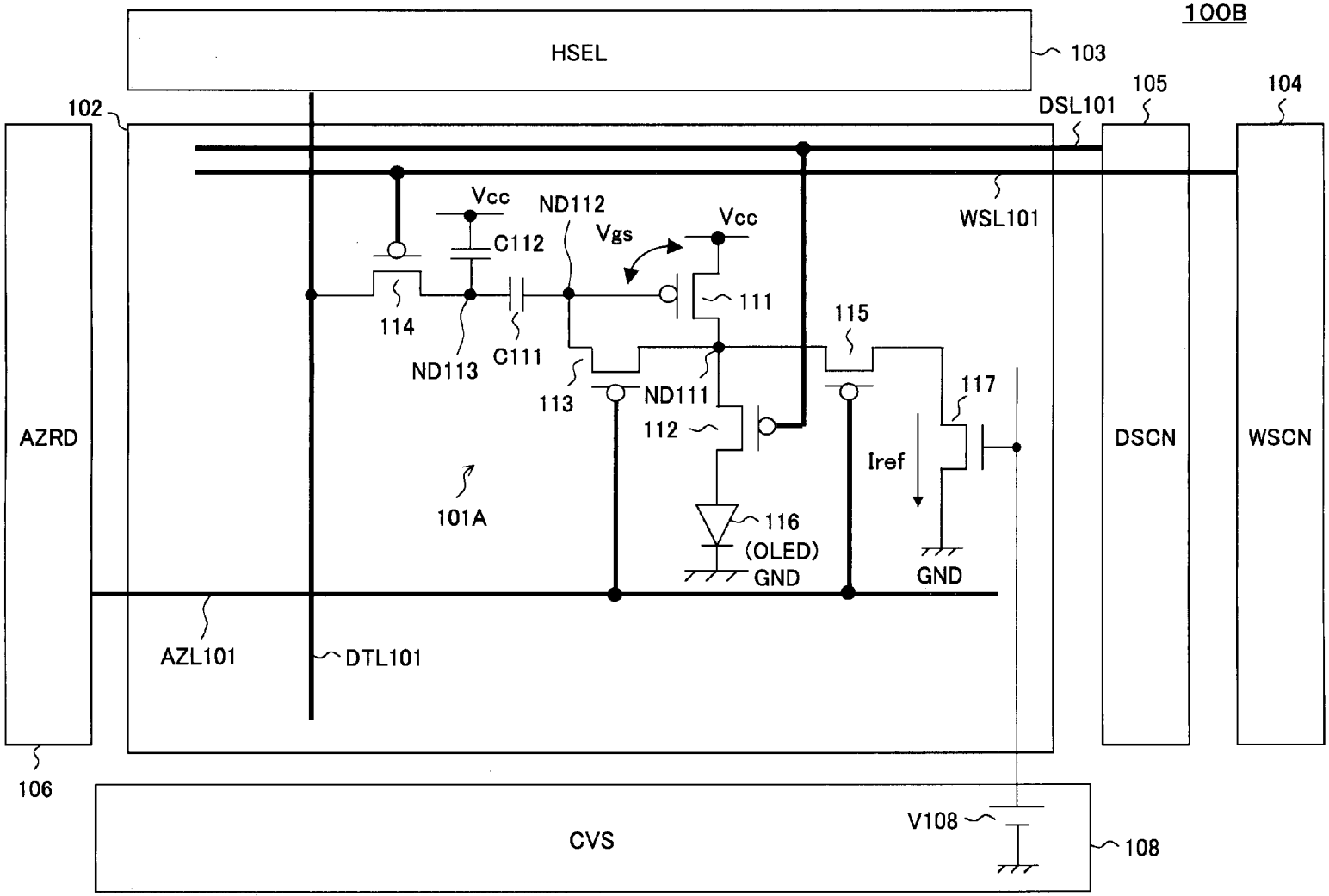
FIG. 16 is a circuit diagram of the concrete configuration of a pixel circuit according to the third embodiment in the organic EL display device of FIG. 15.

FIG. 15 is a block diagram of the configuration of an organic EL display device employing pixel circuits according to a third embodiment. FIG. 16 is a circuit diagram of the concrete configuration of a pixel circuit according to the third embodiment in the organic EL display device of FIG. 15.

The difference of the third embodiment from the above second embodiment resides in that the constant voltage source 108 is provided and in that common voltage supply lines VSL101 to VSL10*n* are laid for every column and connected to the gates of TFT 117 of the pixels. The voltage source V108 is connected to the voltage supply lines VSl101 to VSL10*n*.

The rest of the configuration is the same as the second embodiment.

According to the third embodiment, the same effects as those of the first embodiment mentioned above can be obtained.

Fourth Embodiment

Figure 17:
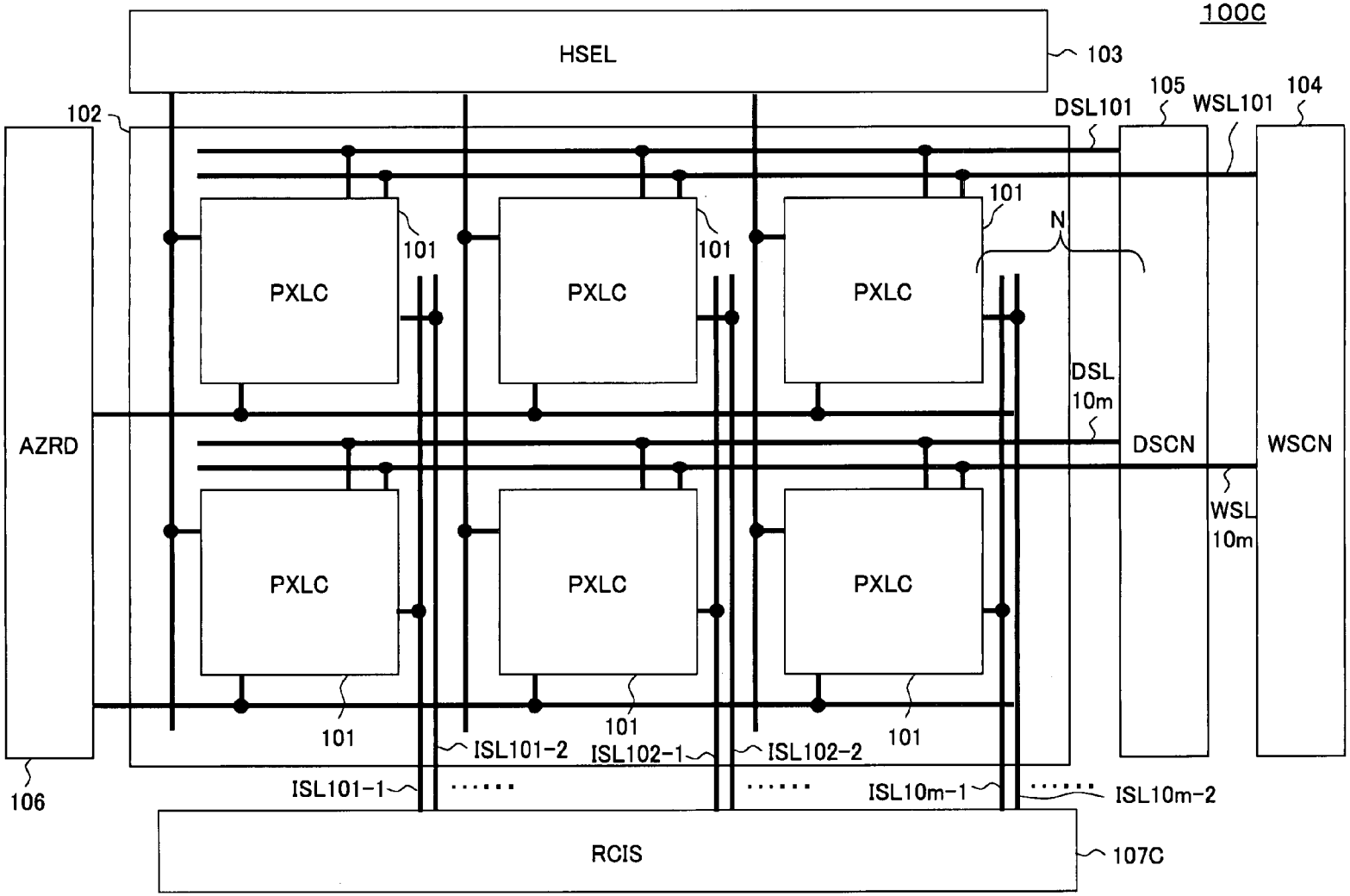
FIG. 17 is a block diagram of the configuration of an organic EL display device employing pixel circuits according to a fourth embodiment.
Figure 18:
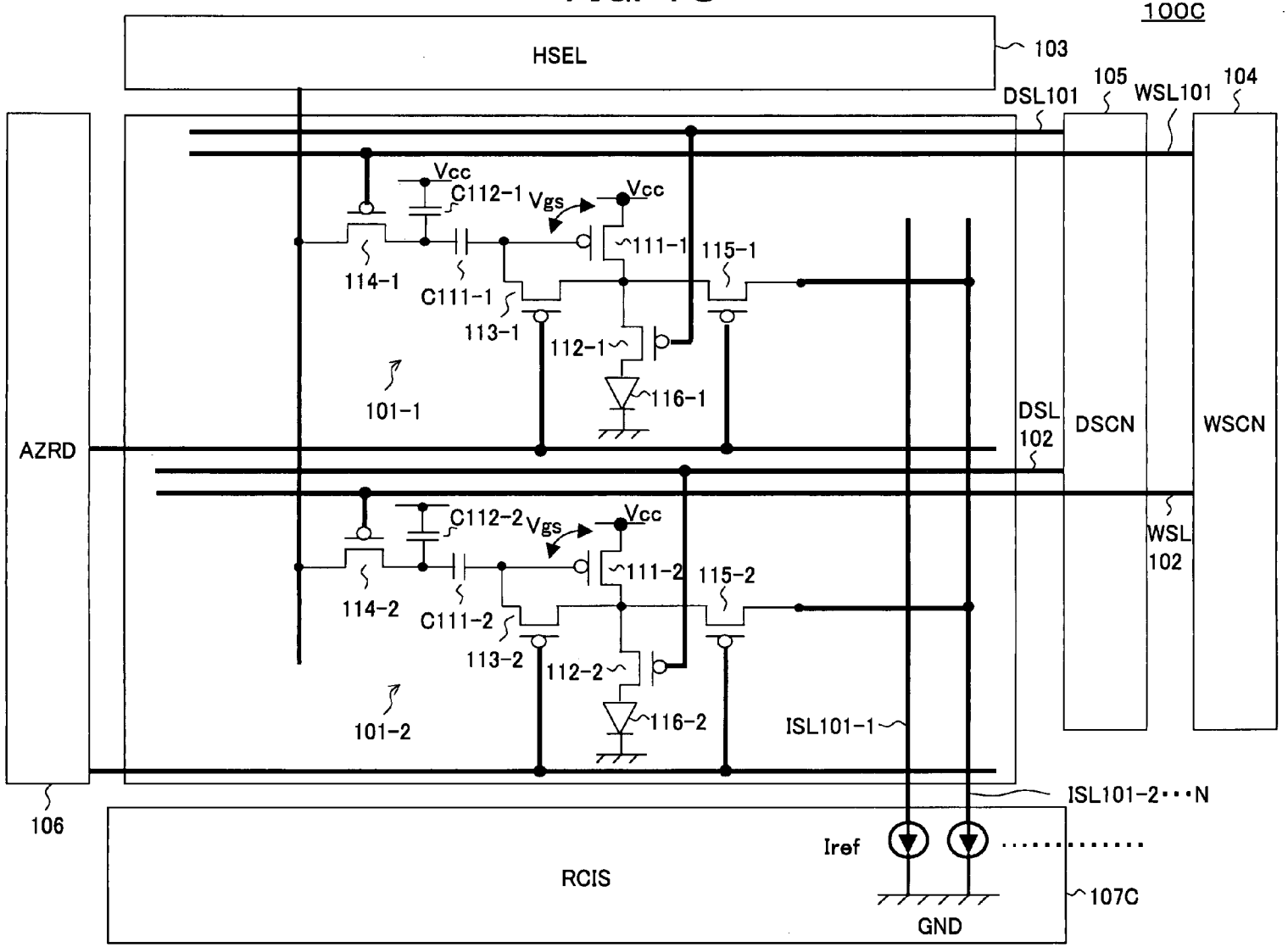
FIG. 18 is a circuit diagram of a concrete configuration of a pixel circuit according to the fourth embodiment in the organic EL display device of FIG. 17.

FIG. 17 is a block diagram of the configuration of the organic EL display device employing a pixel circuit according to the fourth embodiment. FIG. 18 is a circuit diagram of the concrete configuration of a pixel circuit according to the fourth embodiment in the organic EL display device of FIG. 17. Further, FIGS. 19A to 19G are timing charts of the operation of the circuit of FIG. 18.

The difference of the fourth embodiment from the first embodiment resides in that, instead of providing one reference current supply line ISL for every pixel column, it is configured so that a plurality of, for example N (for example N=m) reference current supply lines ISL101-1 to ISL101-N, ISL102-1 to ISL102-N, . . . , and ISL10*m*-1 to ISL10*m*-N are provided and connected to different reference current supply lines for every pixel circuit 101 for example.

The rest of the configuration is the same as the first embodiment.

According to the fourth embodiment, as shown in FIG. 19C, as the auto-zero period (correction period of the threshold value Vth and the mobility μ), setting the period to N times 1H in the case of the first embodiment becomes possible. Due to this, even if the screen is large and the signal line capacity is large (heavy), variation of the threshold value Vth in the pixels is cancelled, and an image quality having a good uniformity can be obtained.

The effects of this fourth embodiment will be explained in further detail in relation to FIGS. 20A and 20B.

Figure 20B:
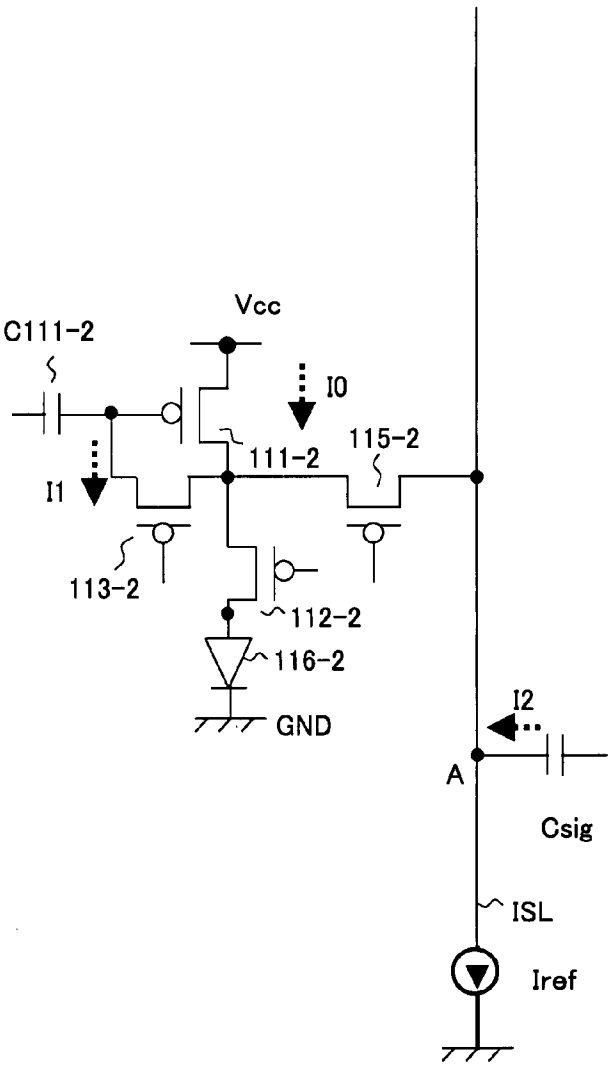
FIGS. 20A and 20B are diagrams for explaining the advantages of the fourth embodiment.
Figure 20A:
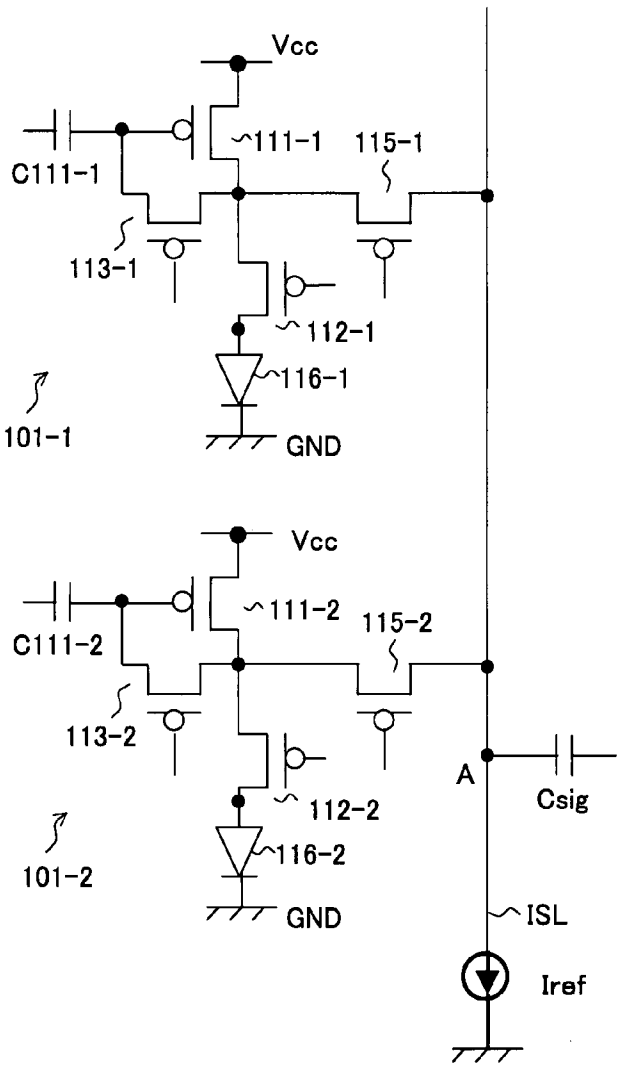

Here, for example, as shown in FIG. 20A, the operation where one reference current supply line ISL is provided for every pixel column will be simply explained. First, by turning on the TFT 113-1 and TFT 115-1 of the pixel circuit 101-1 of the first row, the reference current Iref flows through the drive transistor TFT 111-1, and the gate voltage corresponding to the reference current Iref is written into the capacitor C111-1. This gate voltage is based on the above equation 1 for the saturated region driving. At this time, the gate voltage of the TFT 113-1 is simultaneously written into also the capacity Csig of the reference current supply line ISL. Next, the TFT 113-1 and the TFT 115-1 of the pixel circuit 101-1 of the first row are turned off to turn on the TFT 113-2 and the TFT 115-2 of the pixel circuit 101-2 of the second row. Below, the same operation is repeated.

Here, the writing when the threshold value Vth of the drive transistor TFT 111 of the pixel circuit varies will be considered. For example, after correcting the variation of the threshold value Vth of the TFT 111-1 of the pixel circuit 101-1 of the first row, the voltage change of the A point in the reference current supply line ISL when correcting the variation of the threshold value Vth of the TFT 111-2 of the pixel circuit 101-2 of the second row will be considered. For example, assume that Iref =2 μA, and the threshold values Vth have differences of 2.0V, 2.3V, and 0.3V between the TFT 111-1 of the pixel circuit 101-1 of the first row and the TFT 111-2 of the pixel circuit 101-2 of the second row. Due to the variation of the threshold value Vth, the gate voltage of the drive transistor TFT 111-1 of the pixel circuit 101-1 of the first row with respect to the reference current Iref becomes 8.0V, and the gate voltage of the TFT 111-2 of the second row becomes 7.7V. That is, the potential (A) of the reference current supply line ISL will change from 8.0V to 7.7V. The operation diagram at the time of this voltage change is shown in FIG. 20B.

As the path of the current flowing when the potential of the A point changes, there are paths of currents I0, I1, and I2 of FIG. 20B. They become Iref=2 μA=I0+I1+I2 based on Kirchhoff's Law. I0 becomes the current flowing through the drive transistor TFT 111-2, I1 becomes the current flowing out of the pixel capacitor C111-2, and I2 becomes the current flowing out of the capacitor Csig of the reference current supply line ISL. Here, it is necessary to discharge the C111 and Csig from 8.0V to 7.7V. At the start when the TFT 115-2 is turned on, the gate voltage of the TFT 111-2 is 8.0V since the potential of the A point is written, and a current smaller than 2 μA is flowing through I0. The C111-2 and Csig are discharged by the current of the difference, and the gate voltage of the TFT 111-2 and the potential of the A point approach 7.7V. However, as the gate voltage approaches 7.7V, I0≅2 μA stands, and both of I1 and I2 become very small values. It is necessary to discharge the C111-2 and Csig with this small current. A long time is required for completely discharging them to 7.7V.

Particularly, the capacitance Csig of the reference current supply line ISL increases when the panel is large sized. That is, a very long time is required for the transition of the gate voltage in stages having different threshold values Vth. For example, as in the first embodiment, when one reference current supply line ISL is provided for one column of pixels, it is necessary to correct the variation of the threshold value Vth of. the TFT 111 serving as the drive transistor in 1H period, but when the panel is large sized, there the correction of the variation of the threshold value Vth may not be finished in 1H period. Contrary to this, in the fourth embodiment, a plurality of reference current supply lines ISL are provided for every pixel column, and it becomes possible to set a long correction period such as N×H as the auto-zero period (correction period of the threshold value Vth and the mobility μ). As a result, even if the panel is large sized, variation of the threshold value Vth in the pixel circuit can be reliably cancelled, and an image quality having a good uniformity can be obtained also in a large sized screen.

Fifth Embodiment

Figure 21:
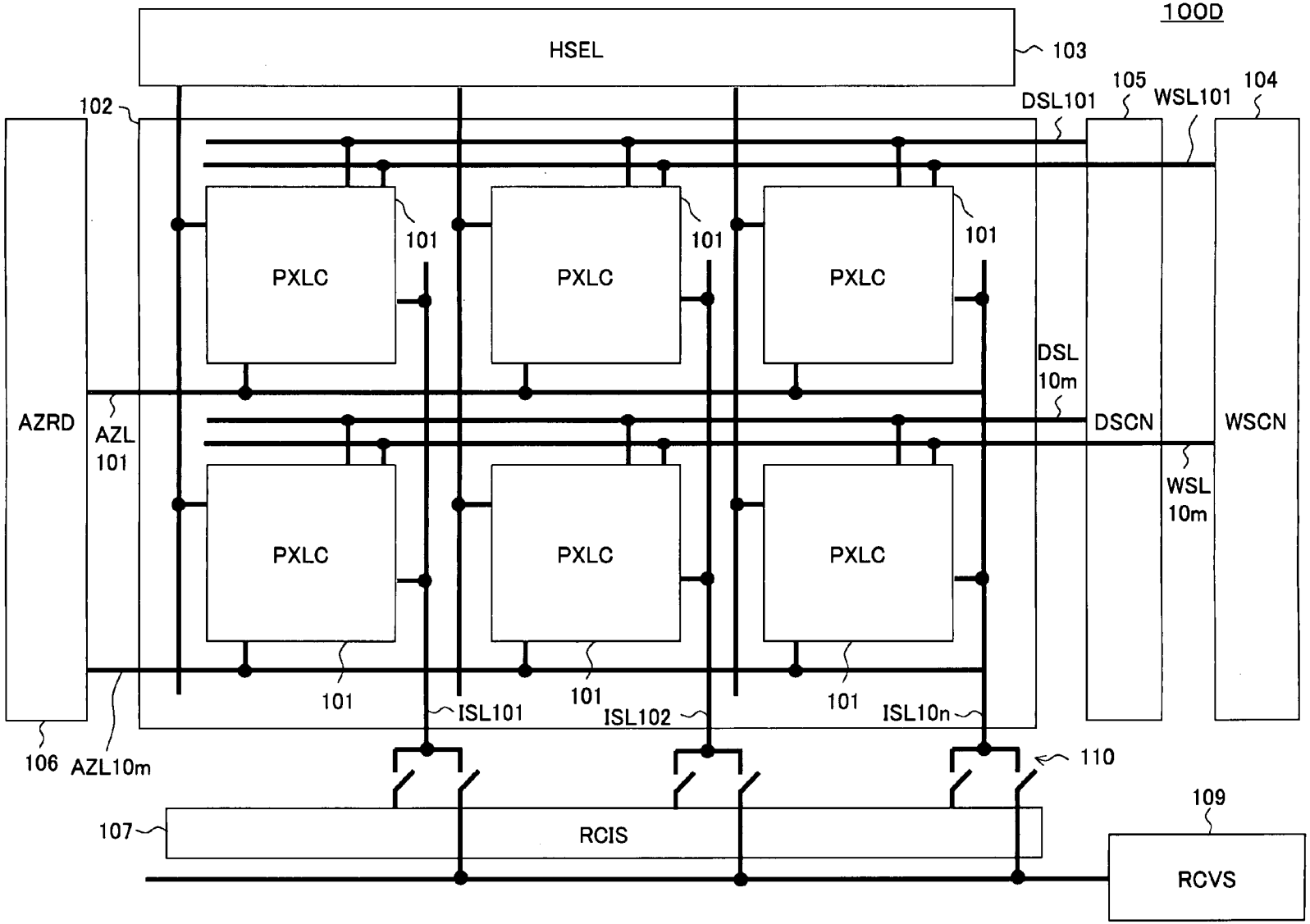
FIG. 21 is a block diagram showing the configuration of an organic EL display device employing pixel circuits according to a fifth embodiment.
Figure 22:
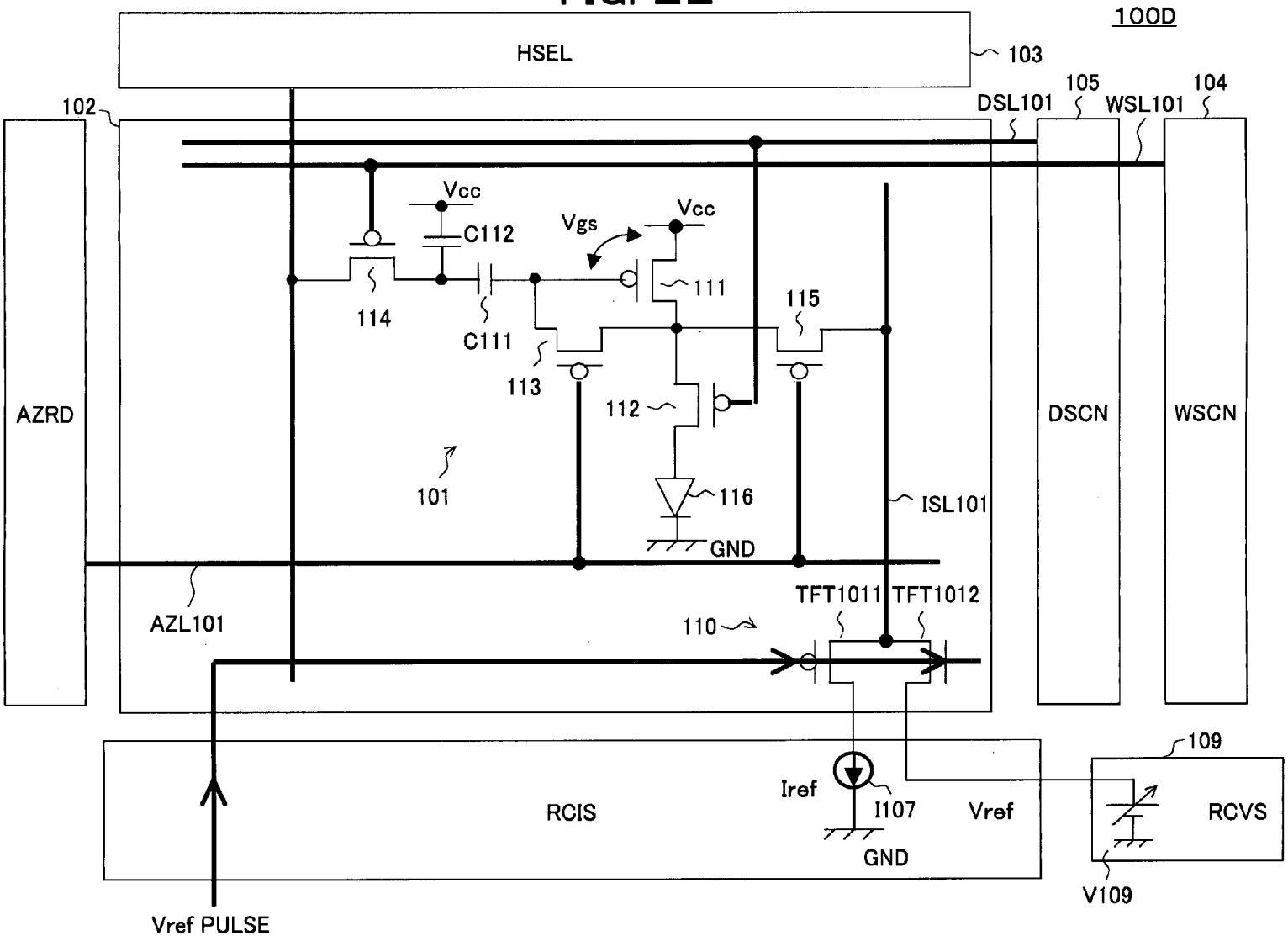
FIG. 22 is a circuit diagram showing a concrete configuration of a pixel circuit according to the fifth embodiment in the organic EL display device of FIG. 21.

FIG. 21 is a block diagram of the configuration of an organic EL display device employing pixel circuits according to the fifth embodiment. FIG. 22 is a circuit diagram of the concrete configuration of a pixel circuit according to the fifth embodiment in the organic EL display device of FIG. 21. Further, FIGS. 23A to 23H are timing charts of the operation of the circuit of FIG. 22.

The difference of the fifth embodiment from the fourth embodiment resides in that to reliably cancel the variation of the threshold value Vth in the pixel circuit even if the panel is large sized, a configuration of supplying the reference voltage Vref to the reference current supply line before correcting the variation of the threshold value Vth, that is, precharging the same, is employed in place of the configuration of providing a plurality of reference current supply lines for every pixel column and connecting them to the different reference current supply lines for every pixel circuit 101.

For this reason, in a display device 100D according to the fifth embodiment, as shown in FIG. 21, the configuration is made so that, in addition to the reference constant current source (RCIS) 107, a reference constant voltage source (RCVS) 109 and a switch circuit 110 are provided, and the reference voltage Vref or the reference current Iref is selectively supplied to the reference current supply lines ISL101 to ISL10*n* via the switch circuit 110.

Figure 23:
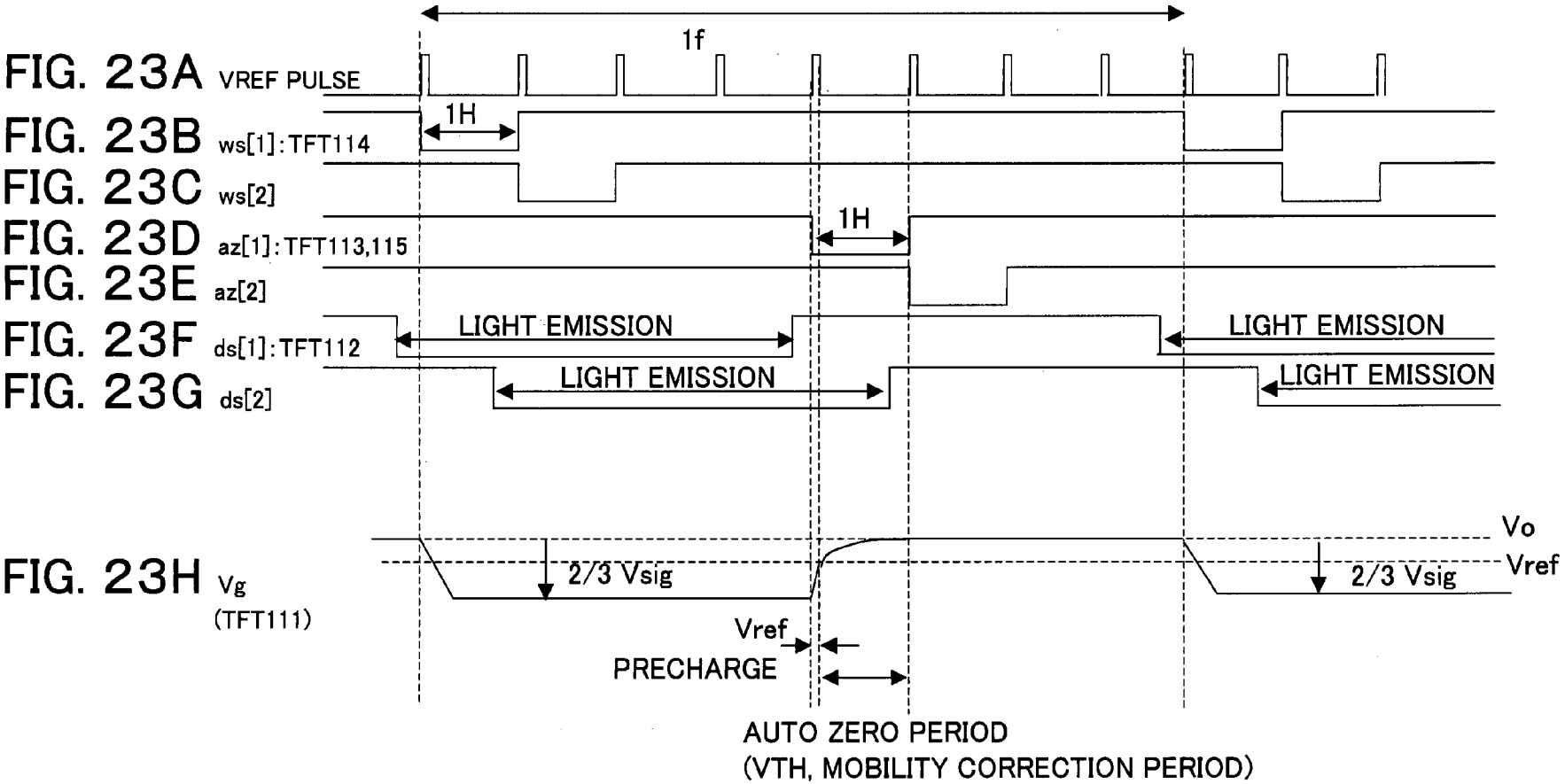
FIGS. 23A to 23H are timing charts for explaining the operation of the fifth embodiment.

In the switch circuit 110, for example, as shown in FIG. 22, a switch comprising a p-channel TFT 1011 having a source and drain connected to the constant current source I107 and the reference current supply line ISL101, and an n-channel TFT 1012 having a source and drain connected to the constant voltage source 109 and the reference current supply line ISL101 is provided corresponding to the reference current supply lines ISL101 to ISL10*n*. Then, by the pulse signal Vref as shown in FIG. 23A, the TFT 1011 and TFT 1012 are complementarily turned on/off.

The rest of the configuration is the same as the first and fourth embodiments.

The display device according to the fifth embodiment enables cancellation of the variation of the threshold value Vth without increasing the number of the reference current supply lines as much as possible. As shown in FIGS. 23A to 23H, before correcting the variation of the threshold value Vth, the pulse signal Vref is input to the switch circuit 110, the TFT 1012 of the switch is turned on for a predetermined period, and the reference voltage Vref is supplied to the reference current supply lines ISL101 to ISL10*n*. The reference voltage Vref is set at for example the intermediate value of the variation of the threshold value Vth. Due to this, the correction period of the variation of the threshold value Vth can be shortened, and it becomes possible to reduce the variation.

In this way, in the precharge period, the reference voltage Vref of an intermediate value (center value) of the variation of the threshold value Vth is written into the reference current supply lines ISL101 to ISL10*n*. In this case, the voltage is written, and the reference voltage Vref can be written in a short time even if the capacitances of the reference current supply lines ISL101 to ISL10*n* are large.

Here, the potential change of the reference current supply line when the threshold values Vth of the adjacent pixels differ by ±0.3 V will be considered. As in the first embodiment, where precharge is not carried out, the potential of the reference current supply line changes from the gate voltage of the previous stage to the gate voltage of the stage in question. At this time, when the threshold value Vth differs by ±0.3V between adjacent pixels, the voltage change of this reference current-voltage supply line becomes 0.6V. This transition is too large, so there is the apprehension that the change will not be complete in the period of correction of the variation of the threshold value Vth and the shortage ΔV thereof will appear in the variation of uniformity as the Vth variation. Since the value of this ΔV is proportional to the transition, the larger the variation, the larger the ΔV too, and the uniformity is liable to deteriorate too.

On the other hand, if writing the reference voltage Vref, then, as shown in FIGS. 23A to 23H, correcting variation of the threshold value Vth as in the fifth embodiment, the transition of the reference current supply line will become a good 0.3V. That is, in comparison with the case where precharge is not carried out, the amount to be corrected is halved. Accordingly, also the shortage of change ΔV in the Vth correction becomes half or less in comparison with the case where the precharge is not carried out. Due to this, variation in the uniformity due to variation of the threshold value Vth particularly in a large sized organic EL panel can be corrected in a shorter time. Accordingly, the number of the reference current supply lines can be reduced in comparison with the fourth embodiment. Also, the pixel layout becomes easy. Further, since the variation of all threshold values Vth is corrected based on the reference voltage Vref, the Vth can be corrected without an influence of the Vth variation of the pixel of the previous stage.

Further, by making it possible to adjust the reference voltage Vref from the outside, the optimum reference voltage Vref can be adjusted for every panel. Due to this, it can be adjusted to a point where the variation of the Vth in a frame becomes minimum while viewing the image quality, and the yield in the uniformity image quality can be improved.

Sixth Embodiment

Figure 24:
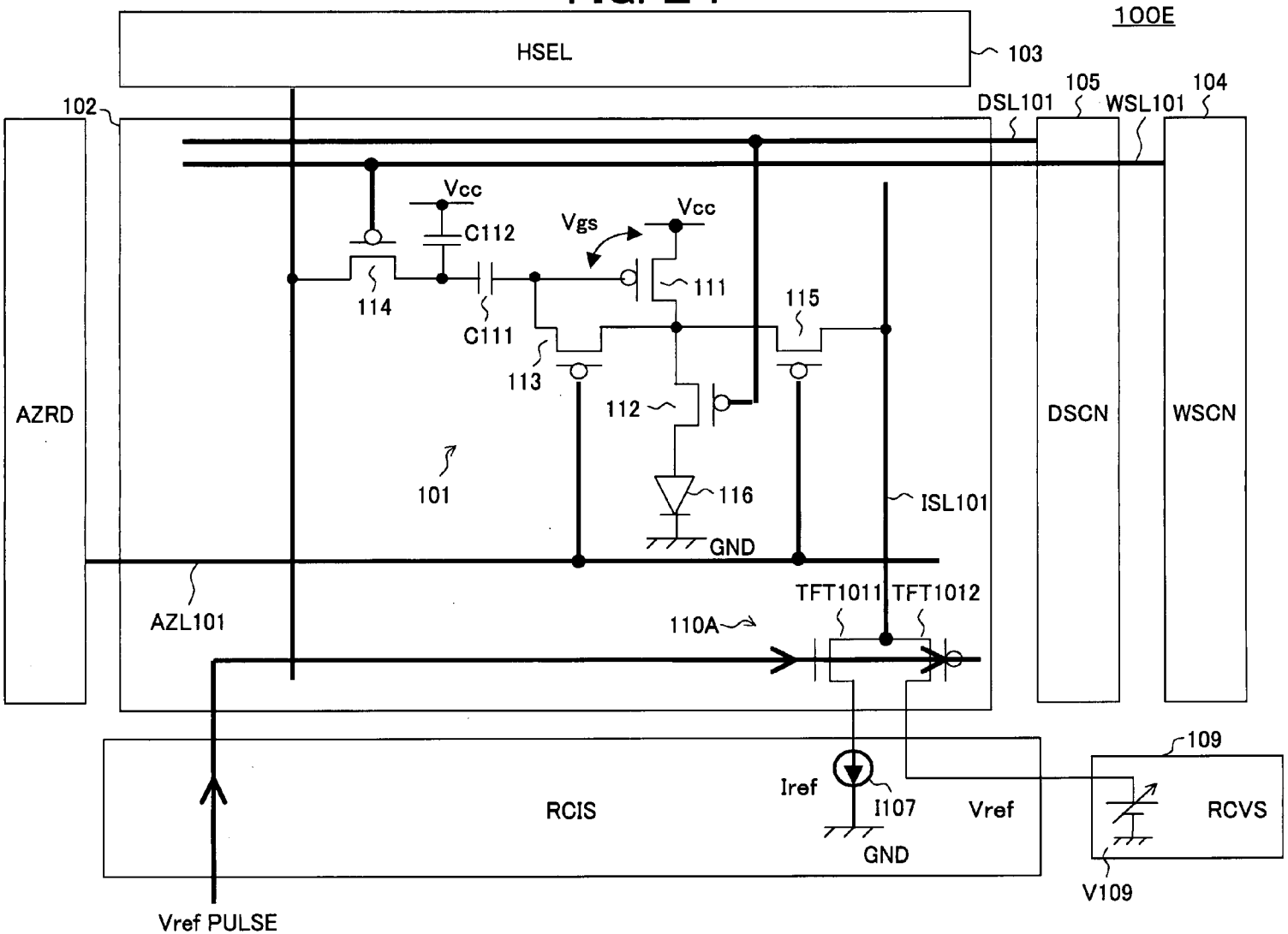
FIG. 24 is a block diagram showing the configuration of an organic EL display device employing pixel circuits according to a sixth embodiment.

FIG. 24 is a block diagram of the configuration of an organic EL display device employing pixel circuits according to the sixth embodiment.

The difference of the sixth embodiment from the fifth embodiment resides in that an n-channel TFT is used in place of a p-channel TFT as the TFT 1011 of the switch circuit 110A, and a p-channel TFT is used in place of an n-channel TFT as the TFT 1012. Namely, the TFT configuring the switch circuit may be either of the n-channel or the p-channel so far as the current or voltage can be selectively supplied to the reference current supply line ISL. The rest of the configuration is the same as the fifth embodiment.

According to the sixth embodiment, the same effects as the fifth embodiment can be obtained.

Note that, in the first to sixth embodiments, as the layout of the auto-zero circuit (AZRD) 106, the write scanner (WSCN) 104, and the drive scanner (DSCN) 105, the explanation was given by taking as the example the case where the auto-zero circuit (AZRD) 106 was arranged at the left side in the drawing of the pixel array portion 102, and the write scanner (WSCN) 104 and the drive scanner (DSCN) 105 were arranged at the right side, but various other modes are possible, for example arranging all at the left side or right side; arranging the auto-zero circuit (AZRD) 106 at the right side and arranging the write scanner (WSCN) 104 and the drive scanner (DSCN) 105 at the left side; or combining the auto-zero circuit (AZRD) 106 and the write scanner (WSCN) 104 or the drive scanner (DSCN) 105 and arranging them at the left side or right side.

Summarizing the effects of the invention, as explained above, according to the present invention, variation of the on current due to the mobility at the time of a white display can be suppressed, and the uniformity with respect to variation in mobility can be greatly enhanced in comparison with the conventional method. Further, since the variation of the threshold value is canceled by passing a reference current, the time taken for cancellation of the variation of the threshold value is shortened, and deterioration of the uniformity due to variation of the threshold value can be prevented. Further, once the variation of the threshold value is canceled, the gate potential of the drive transistor does not fluctuate thereafter, therefore, the time of a so-called auto-zero operation does not depend upon the absolute value of the threshold value, and the increase of the number of steps due to the setting of the auto-zero time can be suppressed.

Further, instead of providing one reference current supply line for every pixel column, by providing a plurality of reference current supply lines and connecting them to for example the different reference current supply line for every pixel circuit, the setting of a period N times the size becomes possible as the auto-zero period (correction period of the threshold value Vth and the mobility μ). Due to this, even if the signal line capacitance is large (heavy) in a large screen, the variation of the threshold value Vth in the pixel is canceled, and an image quality having a good uniformity can be obtained.

Further, by precharging before correcting the variation of the threshold value Vth, even in the short correction period of the variation of the threshold value, an image quality having a good uniformity can be obtained. Further, it becomes possible to reduce the number of the reference current supply lines, and also the pixel layout becomes easy.

As described above, according to the present invention, a current having a desired value can be supplied to the light emitting element of each pixel stably and correctly without being influenced by variation of the threshold value of the active element inside the pixel or variation of the mobility, so it becomes possible to display a high quality image.

While the invention has been described with reference to specific embodiments chosen for purpose of illustration, it should be apparent that numerous modifications could be made thereto by those skilled in the art without departing from the basic concept and scope of the invention.

The invention claimed is:

1. A pixel circuit for driving an electro-optic element with a luminance changing according to a flowing current, comprising:

a data line through which a data signal in accordance with luminance information is supplied;

a first control line;

first, second, and third nodes;

first and second reference potentials;

a reference current supplying means for supplying a predetermined reference current;

a drive transistor forming a current supply line between a first terminal and a second terminal connected to said first node and controlling a current flowing through said current supply line in accordance with the potential of the control terminal connected to said second node;

a first switch connected to said first node;

a second switch connected between said first node and said second node;

a third switch connected between said data line and said third node and controlled in conduction by said first control line;

a fourth switch connected between said first node and said reference current supplying means; and a coupling capacitor connected between said second node and said third node, wherein the current supply line of said drive transistor, said first node, said first switch, and said electro-optic element are connected in series between said first reference potential and second reference potential.

2. A pixel circuit as set forth in claim 1, wherein:

the circuit further comprises second, third, and fourth control lines, and said first switch is controlled in conduction by said second control line, said second switch is controlled in conduction by said third control line, and said fourth switch is controlled in conduction by said fourth control line.

3. A pixel circuit as set forth in claim 2, wherein said third control line and fourth control line are shared, and said second switch and fourth switch are controlled in conduction by one control line.

4. A pixel circuit as set forth in claim 1, wherein when said electro-optic element is driven, as a first stage, said second switch and said fourth switch are made conductive for a predetermined time to electrically connect said first node and said second node, then the reference current is supplied to the first node, and as a second stage, said second switch and said fourth switch are held in the non-conductive state after an elapse of the predetermined time, and as a third stage, said third switch is made conductive by said first control line, said first switch is made conductive, and the data propagated through said data line is written into said third node, then said third switch is held in the non-conductive state and a current in accordance with said data signal is supplied to said electro-optic element.

5. A pixel circuit as set forth in claim 4, wherein the value of said reference current is set at a value corresponding to an intermediate color of the light emission of said electro-optic element.

6. A display device comprising:

a plurality of pixel circuits arranged in a matrix;

a data line laid for every column of the matrix array of said pixel circuits and supplied with a data signal in accordance with the luminance information;

a first control line laid for every row of the matrix array of said pixel circuit;

first and second reference potentials; and a reference current supplying means for supplying a predetermined reference current, wherein each pixel circuit has:

first, second, and third nodes, a drive transistor for forming a current supply line between the first terminal and the second terminal connected to said first node and controlling the current flowing through said current supply line in accordance with the potential of the control terminal connected to said second node, a first switch connected to said first node, a second switch connected between said first node and said second node, a third switch connected between said data line and said third node and controlled in conduction by said first control line, a fourth switch connected between said first node and said reference current supplying means, and a coupling capacitor connected between said second node and said third node, and the current supply line of said drive transistor, said first node, said first switch, and said electro-optic element are connected in series between said first reference potential and second reference potential.

7. A display device as set forth in claim 6, wherein:

said reference current supplying means includes a reference current source and a reference current supply line laid for every column of the matrix array of said pixel circuits and supplied with the reference current from said reference current source, and said fourth switch is connected between said first node and the reference current supply line.

8. A display device as set forth in claim 6, wherein:

said reference current supplying means includes a reference current source and a plurality of reference current supply lines laid for every column of the matrix array of said pixel circuits and supplied with the reference current from said reference current source, and the plurality of pixel circuits of the same column are connected to different reference current supply lines via said fourth switch.

9. A display device as set forth in claim 7, wherein the device further comprises a reference voltage supplying means for selectively supplying a predetermined reference voltage to said reference current supply line.

10. A display device as set forth in claim 9, wherein said reference voltage supplying means further comprises a reference voltage source and a switch circuit selectively connecting said reference current source and said reference voltage source to said reference current supply line.

11. A display device as set forth in claim 7, wherein when said electro-optic element is driven, as a first stage, said second switch and said fourth switch are made conductive for a predetermined time to electrically connect said first node and said second node, then the reference current is supplied to the first node, as a second stage, said second switch and said fourth switch are held in the non-conductive state after an elapse of a horizontal scanning period, and as a third stage, said third switch is made conductive by said first control line, said first switch is made conductive and the data propagated through said data line is written into said third node, then said third switch is held in the non-conductive state and a current in accordance with said data signal is supplied to said electro-optic element.

12. A display device as set forth in claim 11, wherein the value of said reference current is set to a value corresponding to an intermediate color of the light emission of said electro-optic element.

13. A display device as set forth in claim 8, wherein when said electro-optic element is driven, as a first stage, said second switch and said fourth switch are made conductive for a predetermined time to electrically connect said first node and said second node, then the reference current is supplied to the first node, as a second stage, said second switch and said fourth switch are held in the non-conductive state after an elapse of a time of a few times the horizontal scanning period, and as a third stage, said third switch is made conductive by said first control line, said first switch is made conductive, and the data propagated through said data line is written into said third node, then said third switch is held in the non-conductive state and a current in accordance with said data signal is supplied to said electro-optic element.

14. A display device as set forth in claim 13, wherein the value of said reference current is set to a value corresponding to an intermediate color of the light emission of said electro-optic element.

15. A display device as set forth in claim 9, wherein, where said electro-optic element is driven, as a first stage, said reference current supply line is precharged by the supply of the reference voltage by said reference voltage supplying means, as a second stage, said second switch and said fourth switch are made conductive for a predetermined time to electrically connect said first node and said second node, then supply the reference current to the first node, as a third stage, said second switch and said third switch are held in the non-conductive state by said third control line after an elapse of the horizontal scanning period, and as a fourth stage, said third switch is made conductive by said first control line, said first switch is made conductive, and the data propagated through said data line is written into said third node, then said third switch is held in the non-conductive state and a current in accordance with said data signal is supplied to said electro-optic element.

16. A display device as set forth in claim 15, wherein the value of said reference current is set to a value corresponding to an intermediate color of the light emission of said electro-optic element.

17. A display device as set forth in claim 15, wherein the value of said reference voltage is set to an intermediate value of the variation of the threshold value of said drive transistor.

18. A display device comprising:

a plurality of pixel circuits arranged in a matrix;

a data line laid for every column of the matrix array of said pixel circuits and supplied with a data signal in accordance with luminance information;

a first control line laid for every row of the matrix array of said pixel circuits; and first and second reference potentials, wherein each pixel circuit has:

a reference current supplying means for supplying a predetermined reference current, first, second, and third nodes, a drive transistor for forming a current supply line between the first terminal and the second terminal connected to said first node and controlling the current flowing through said current supply line in accordance with the potential of the control terminal connected to said second node, a first switch connected to said first node, a second switch connected between said first node and said second node, a third switch connected between said data line and said third node and controlled in conduction by said first control line, a fourth switch connected between said first node and said reference current supplying means, and a coupling capacitor connected between said second node and said third node, and the current supply line of said drive transistor, said first node, said first switch, and said electro-optic element are connected in series between said first reference potential and second reference potential.

19. A driving method of a pixel circuit comprising:

an electro-optic element with a luminance changing according to the flowing current, a data line supplied with the data signal in accordance with luminance information, first, second, and third nodes, a reference current supplying means for supplying a predetermined reference current, a drive transistor for forming a current supply line between the first terminal and the second terminal connected to said first node and controlling the current flowing through said current supply line in accordance with the potential of the control terminal connected to said second node, a first switch connected to said first node, a second switch connected between said first node and said second node, a third switch connected between said data line and said third node and controlled in conduction by said first control line, a fourth switch connected between said first node and said reference current supplying means, and a coupling capacitor connected between said second node and said third node, and the current supply line of said drive transistor, said first node, said first switch, and said electro-optic element are connected in series between said first reference potential and second reference potential, comprising:

making said second switch and said fourth switch conductive for a predetermined time to electrically connect said first node and said second node and supplying a reference current to the first node, holding said second switch and said third switch in the non-conductive state after the elapse of a predetermined time, making said third switch conductive, making said first switch conductive, and writing data propagated through said data line into said third node, then holding said third switch in the non-conductive state and supplying current in accordance with said data signal to said electro-optic element.

* * * * *